US011707858B1

(12) United States Patent
Mon

(10) Patent No.: US 11,707,858 B1
(45) **Date of Patent: *Jul. 25, 2023**

(54) HANDHELD CUTTING TOOL VARIANTS

(71) Applicant: George Emmanuel Mon, Ladera Ranch, CA (US)

(72) Inventor: George Emmanuel Mon, Ladera Ranch, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/930,328

(22) Filed: Sep. 7, 2022

(51) Int. Cl.
*B26B 5/00* (2006.01)
*B26B 29/02* (2006.01)
*B26B 1/04* (2006.01)

(52) U.S. Cl.
CPC ..... *B26B 5/006* (2013.01); *B26B 1/046* (2013.01); *B26B 29/02* (2013.01)

(58) Field of Classification Search
CPC ..... B26B 5/006; B26B 1/046; B26B 29/02
See application file for complete search history.

(56) References Cited

U.S. PATENT DOCUMENTS 7,024,772 B1 * 4/2006 Shaver ..... B26B 27/005 30/2
7,814,664 B2 * 10/2010 LeBlanc ..... B26B 1/042 30/330
D725,985 S * 4/2015 Kalajyan ..... D8/99
9,943,970 B2 * 4/2018 Glesser ..... B26B 1/048
10,144,139 B2 * 12/2018 Squiers ..... B26B 5/00
10,464,224 B2 * 11/2019 Dechant ..... B26B 5/00
11,426,888 B1 * 8/2022 Mon ..... B25G 1/08
2009/0223061 A1 * 9/2009 Seber ..... B26B 1/048 30/160
2018/0354144 A1 * 12/2018 LeBlanc ..... B26B 1/04
2019/0308335 A1 * 10/2019 Korthuis ..... B26B 5/00
2020/0324423 A1 * 10/2020 Hurwicz ..... B26B 5/005
2021/0354318 A1 * 11/2021 Scimone ..... B26B 1/04

* cited by examiner

*Primary Examiner* — Omar Flores Sanchez

(57) ABSTRACT

The handheld cutting tool variants disclose improvements to the handheld cutting tool of U.S. Pat. No. 11,426,888B1/ application Ser. No. 17/704,935. The handheld cutting tool variants deploying a razor blade have enhanced cutting made possible by either modifying portions or eliminating portions of the blade holder nosing which in turn is made possible by deploying either one of two newly disclosed blade restraint mechanisms. As with application Ser. No. 17/704,935/U.S. Pat. No. 11,426,888-B1, the tool is comprised predominantly of a handle body, a blade holder assembly which serves to deploy and constrain a replaceable blade and a rotational control assembly actuated by the user that enables the blade holder to rotate between retracted and a plurality of extended positions.

9 Claims, 26 Drawing Sheets

HANDHELD CUTTING TOOL VARIANTS

CROSS REFERENCE TO RELATED APPLICATIONS

This application claims the benefit of U.S. Utility Patent 11,326,632 B1—Axially Aligned Coupling, application Ser. No. 17/567,319 filed Jan. 3, 2022 by George E. Mon as sole inventor, the contents of which are incorporated herein by reference in its entirety. The Axially Aligned Coupling of application Ser. No. 17/567,319 is used as a non-limiting element of the presented cutting tools. This application also claims the benefit of U.S. Utility Pat. No. 11,426,888 B1—Handheld Cutting Tool, application Ser. No. 17/704,935 filed Mar. 25, 2022 by George E. Mon as sole inventor, the contents of which are incorporated herein by reference in its entirety.

FIELD OF THE INVENTION

The present invention relates to handheld cutting implements with a replaceable blade.

BACKGROUND OF THE INVENTION

Handheld cutting tools such as utility type knives are generally designed to be portable cutting tools that use replaceable blades which may retract and may have blade holders that pivot into the tool handle so as to prevent inadvertent cutting and enable safe storage and transport. They have handles of sufficient length and of such a form as to be securely held by the user and have the blade at a reasonable distance from the hand for safer operation.

Reference: B26B 5/00; B26B 5/003; B26B 5/005; B26B 1/046; B26B 9/00; B26B 29/00

SUMMARY OF THE INVENTION

The presented cutting tools are variants of the handheld cutting tool disclosed in application Ser. No. 17/704,935. The tools of the current application possess two improvements over Ser. No. 17/704,935: blade holder modifications which improve task specific cutting and newly presented mechanisms for replaceable blade restraint.

Three similar handheld cutting tools are disclosed, each with the characteristics of the improved blade holders and restraint mechanisms: 1) a utility blade cutting tool with a modified blade holder nosing to permit certain cutting tasks and additionally a newly presented utility blade restraint mechanism, the tool hereafter referred to as Utility Blade Tapered Nosing Cutting Tool; 2) a razor blade cutting tool with a modified blade holder nosing to permit certain cutting tasks and additionally a newly presented razor blade restraint mechanism, the tool hereafter referred to as Razor Blade Tapered Nosing Cutting Tool; 3) a razor blade cutting tool with the blade holder nosing essentially eliminated to facilitate certain cutting tasks and a second newly presented razor blade restraint mechanism, the tool hereafter referred to as Razor Blade Holder Open Cutting Tool.

Tool blade holder embodiments deploy either a standard isosceles trapezoid utility knife blade or a standard rectangular single edge razor blade, both being common, inexpensive and replaceable. The razor tools can use razor blades of either a number 9/thickness 0.009 inch or a number 12/thickness 0.012 inch. The blades are nota part of this application and are shown and referenced to facilitate tool presentation.

The presented devices possess some elements and characteristics previously disclosed by application Ser. No. 17/704,935, Handheld Cutting Tool. As these elements and characteristics are germane to the functioning of the tool, their description is presented here in the following paragraphs [0005] to [0008] and also referenced in the Detail Description of the Preferred Embodiments and Drawings of this application.

The presented tools all use the blade holder rotational control mechanism. Specifically, the blade holders rotate on an axis perpendicular to the blade thereby allowing for a retracted position within the tool handle body or one of a plurality of deployed positions selected by the user. The two major blade holder parts are formed with detents to permit engagement in any of these positions. A specifically designed blade holder rotation control assembly, actuated by a push button, allows the blade holder to rotate or, alternately, locks it in the retracted or any of the deployed positions.

Additionally, all the blade holders possess a blade ejector to drive the blade out of the blade holder when required for blade change thus diminishing injury risk to the user.

The handle in some embodiments is presented as an assembly of a plurality of layer type portions together forming a body and serving to conjoin and control the various elements of the tool. Required performance parameters and cost considerations determine materials and methods of manufacture of these layers. These various layer type portions are aligned and constrained to function as one by couplings and fasteners.

The handle of the tools is given one or more of the following features. First, the handle is fashioned to facilitate comfortable and sure grasping. Second, the handle provides a housing for the blade holder and its constituent mechanisms in the retracted position. Optionally, a recess in the handle body provides a compartment for spare blade storage. Because the tool handle body can vary, they are not limited to specific body or proportion. Greater adaptability for use in a variety of applications and with larger range of manufacturing materials and methods are thus attained by the tool design.

The improvements of the tools of this application are in addressing the limitations of prior art in the area of both knife cutting tools for certain specific cutting tasks and in mechanisms for restraining replaceable blades in these devices.

All three of the cutting tools discussed in the preceding paragraphs possess a unique and newly presented blade holder design.

All three of the cutting tools possess a unique and newly presented and claimed blade restraint mechanism to provide blade control. These three releasable blade restraint mechanisms either restrict blade movement during tool use or, when actuated, allow blade release for replacement without disassembly of the tool.

The following detailed description and appended drawings describe and illustrate various exemplary embodiments of the invention. Each demonstrates non-limiting examples of construction while possessing characteristics of the invention. The description and drawings are not intended to limit the scope of the invention in any manner and the methods disclosed are representative of non-limiting applications. With respect to the manufacturing and assembly methods, the presented materials and methods of fabrication and the steps and order of steps are exemplary in nature and therefore not necessary or critical. Other ways or components are also contemplated including but not limited to substituting materials of fabrication.

DETAILED DESCRIPTION OF THE INVENTION

The Utility Blade Tapered Nosing Cutting Tool principal elements, aspects of which were previously disclosed in application Ser. No. 17/704,935, Handheld Cutting Tool, are described and referenced in paragraph [0002] and [0003] of this section. Portions of the cutting tool modified by new material or otherwise improved over the cutting tools presented in application Ser. No. 17/704,935 are presented and referenced in paragraphs [0004] through [0016] of this section. More detailed aspects of the Cutting Tool previously disclosed by Ser. No. 17/704,935 are described and referenced in paragraphs [0018] through [0030]. As this previously disclosed material is necessary to describing the tool presented by this application, it is thus considered germane and necessary for a complete application by the applicant. Together these paragraphs describe the entirety of the tool variant. Please note that most reference numbers in this application are different from that of Ser. No. 17/704,935.

Figure 1:
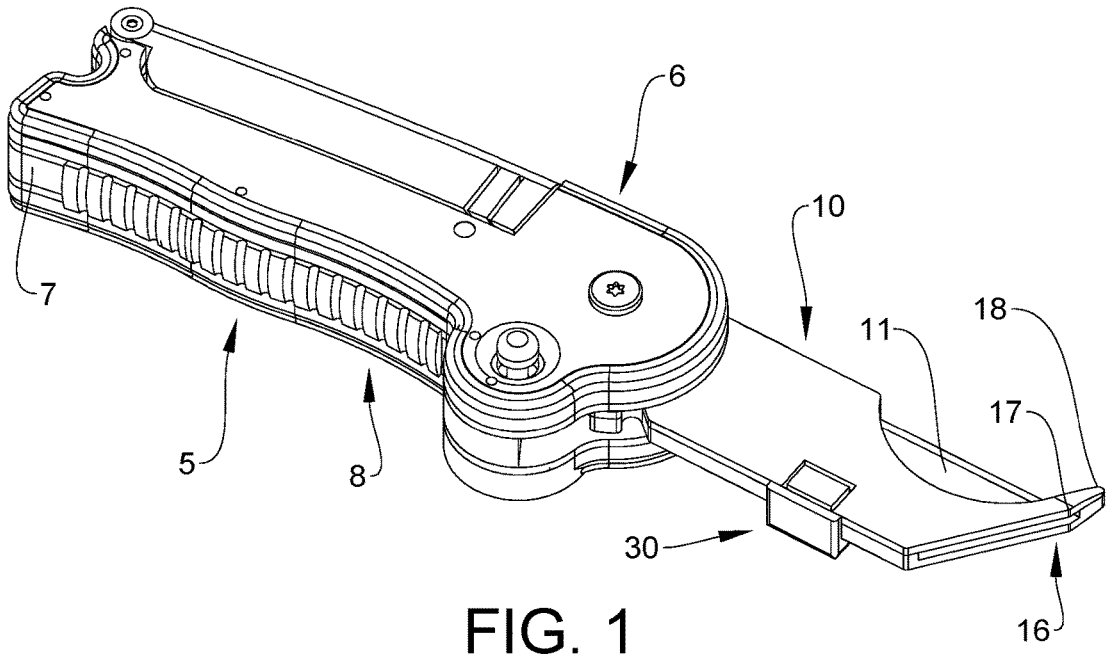
FIG. 1 is a perspective view of the Utility Blade Tapered Nosing Cutting Tool.
Figure 2:
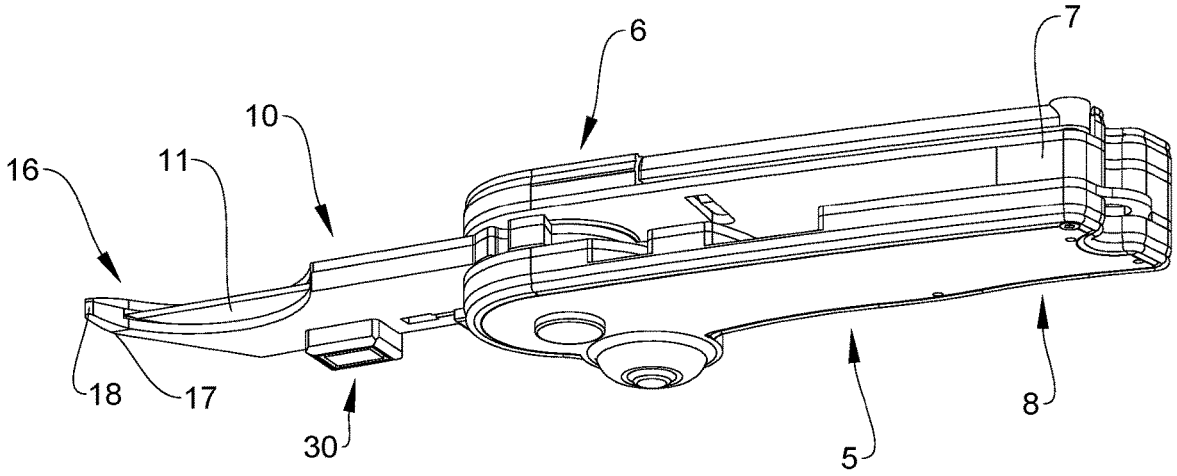
FIG. 2 is an alternate perspective view of the Utility Blade Tapered Nosing Cutting Tool.
Figure 3:
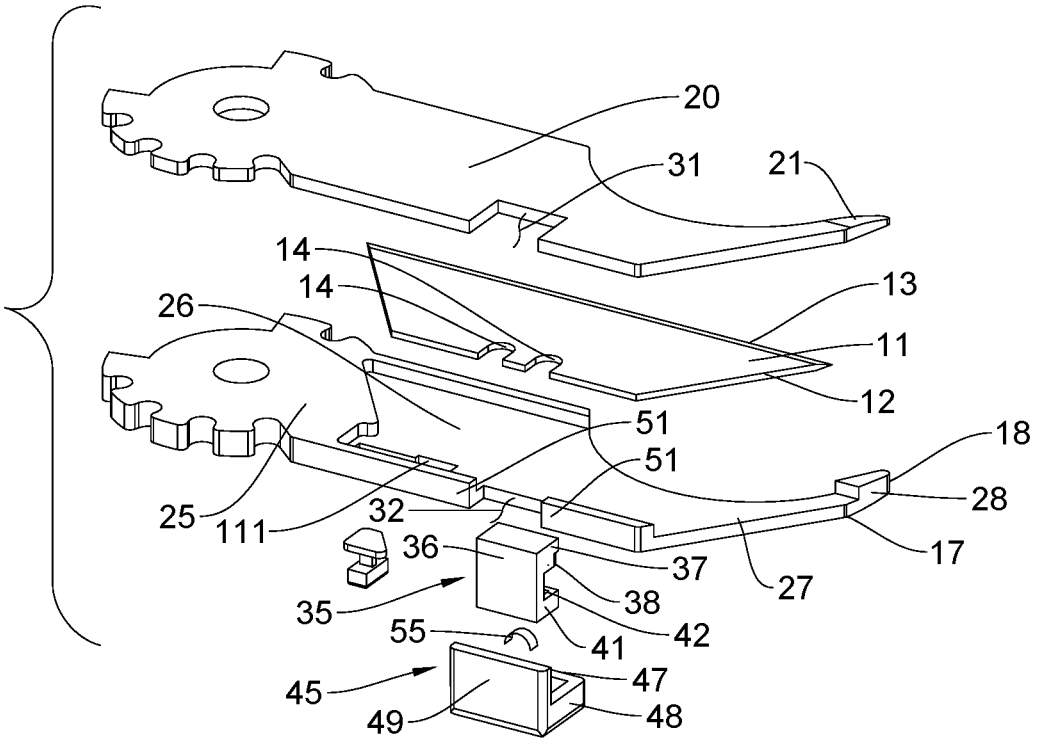
FIG. 3 is an exploded perspective view of the Utility Blade Tapered Nosing Cutting Tool blade holder assembly and linear utility blade restraint mechanism.
Figure 4:
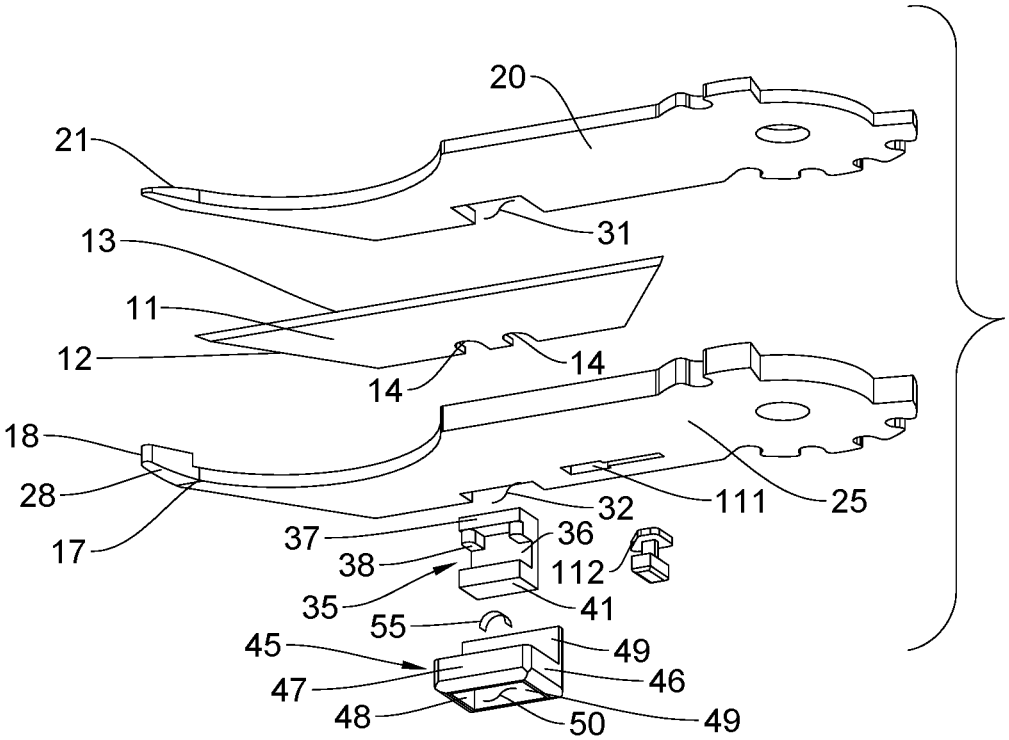
FIG. 4 is an alternate exploded perspective view Utility Blade Tapered Nosing Cutting Tool blade holder assembly and linear utility blade restraint mechanism.

Referring to FIGS. 1-2: The Utility Blade Tapered Nosing Cutting Tool presented is comprised of a utility handle body (5) and a utility tapered nosing blade holder assembly (10). The utility handle body is further comprised of a utility body first half portion (6), utility body center portion (7) and utility body second half portion (8) which are placed together to form a structure to house and deploy a utility tapered nosing blade holder assembly (10) and standard isosceles trapezoid utility blade (11).

Referring to FIGS. 1-4: The utility tapered nosing blade holder assembly is comprised of a utility tapered nosing substantially-planar first part (20) and a utility tapered nosing recessed second part (25) which possesses a utility blade recess (26) in the approximate shape of a standard isosceles trapezoid utility blade. The depth of this recess should be selected so as to prohibit excessive movement of the blade orthogonal to its smallest dimension. The recessed second part (25) recess (26) is substantially open (27) on the distal non parallel side (12) of the blade (11) and partially open to the side where the cutting edge (13) of the blade occurs. When the both blade holder parts (20, 25) are joined, the utility blade is constrained except as to allow movement—extraction—linearly towards where the recessed second part is open (27).

The utility tapered nosing substantially-planar first part nosing portion (21) and recessed second part nosing portion (28) together form the utility tapered blade holder nosing (16; FIG. 1-2). The blade holder nosing (16; FIGS. 1-2) generally parallels the distal non parallel side (12) of the utility blade for the length of that blade edge at which point (17) the nosing portions (21, 28) inflect in the direction of the center of the blade holder. At the point where the nosing portions make contact, the non-contact sides are both tapered toward each other and the distal portion orthogonal to the contact sides are both filleted at the nosing distal end (18). Thus, the blade holder nosing (16), as it proceeds distally, is tapered in all dimensions. The tapering and filleting dimensions are selected for allowing nosing insertion as required by the cutting task.

This blade holder design permits, when used blade edge up and with motion generally away from the user, cutting materials with the blade edge avoiding damaging materials not intended to be cut by virtue of isolating those materials from the blade. The form of this nosing is such that it will facilitate insertion of the nosing between those two types of material. A handheld cutting tool employing the utility tapered nosing blade holder assembly is the subject of independent claim 4.

Referring to FIG. 3-7: The linear utility blade restraint mechanism constituents are described and referenced. An operable utility blade restraint either restricts blade movement during tool use or, when actuated, allows blade release for replacement without disassembly of the tool.

The linear utility blade restraint mechanism (30, FIGS. 2 and 5) is comprised of a first void (31) in the utility tapered nosing substantially-planar first part (20) and a second void (32) in the utility tapered nosing recessed second part (25), a linear utility blade engagement piece (35), a linear utility restraint housing (45) and, lastly, utility linear spring (55). The second void (32) in the recessed second part is smaller than the first void (31) of the planar first part and is sized to mate with the restraint housing (45) and engagement piece (35) as shown by FIGS. 6 and 7. The first void is sized to permit the engagement piece to move to the position shown if FIG. 7, that is above the plane of the substantially-planar first part.

The linear utility blade engagement piece (35) is comprised of a generally planar side portion (36), a generally planar top portion (37) formed orthogonally to and integrally connected to the planar side portion, linear utility blade engagement projections (38) which may be substantially in the shape of the utility blade detents (14) and are integrally formed to the planar holder side portion (36), and an engagement piece base portion (41) orthogonal to and integrally connected to the planar side portion and opposite the planar top portion (37). The engagement piece base portion (41) possesses a rectangular spring recess (42) occurring at the base portion (41) formed to accommodate and constrain the utility linear spring (55).

The linear utility restraint housing (45) is comprised of three equal length sides (46, 47, 48), and a long side (49) together forming an open rectangular space (50) of such dimension as to constrain the blade engagement piece (35) yet permit motion depicted by FIGS. 6 and 7. When the tool is assembled, the long side (49) of the housing is contact with the recessed second part outer edge (51) and the three equal length sides (46, 47, 48) are in contact with the portion of the recessed second part non-blade side adjacent to the second void (32). The long side (49) is of such a dimension parallel to all other sides as to align with non-blade plane of the substantially-planar first part and the planar top portion of the engagement piece in the unactuated position as shown in FIG. 6.

The linear utility blade engagement piece (35) projections (38) engage with the utility blade detents (14) when the linear utility blade restraint mechanism is in the unactuated position as shown in FIG. 6. As the engagement piece is placed at the recessed second part void (32) inner edge and the linear restraint housing (45) long side (49) maintains it in this lateral position, the engagement piece is constrained and limited to axial movement shown in FIGS. 6 and 7.

Figure 5:
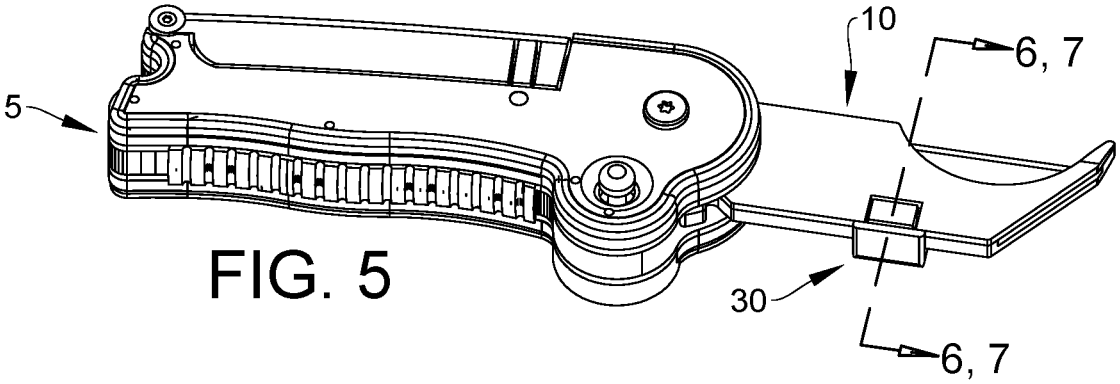
FIG. 5 is a perspective view of Utility Blade Tapered Nosing Cutting Tool defining sections 6 and 7.
Figure 6:
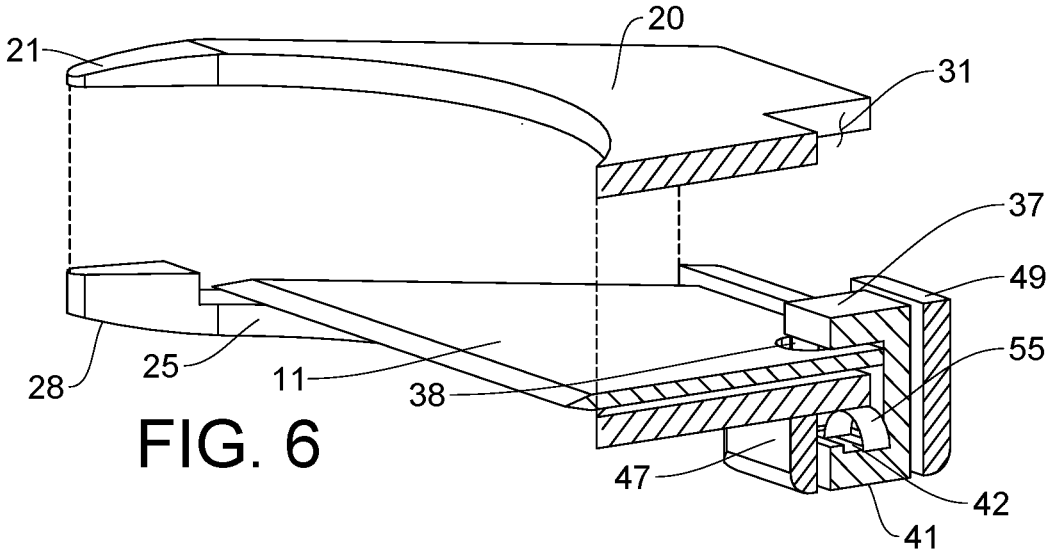
FIG. 6 is a fragmental sectional perspective view of Utility Blade Tapered Nosing Cutting Tool blade holder assembly linear utility blade restraint mechanism in the unactuated/locked position; utility substantially-planar first part is displaced for visual clarity.
Figure 7:
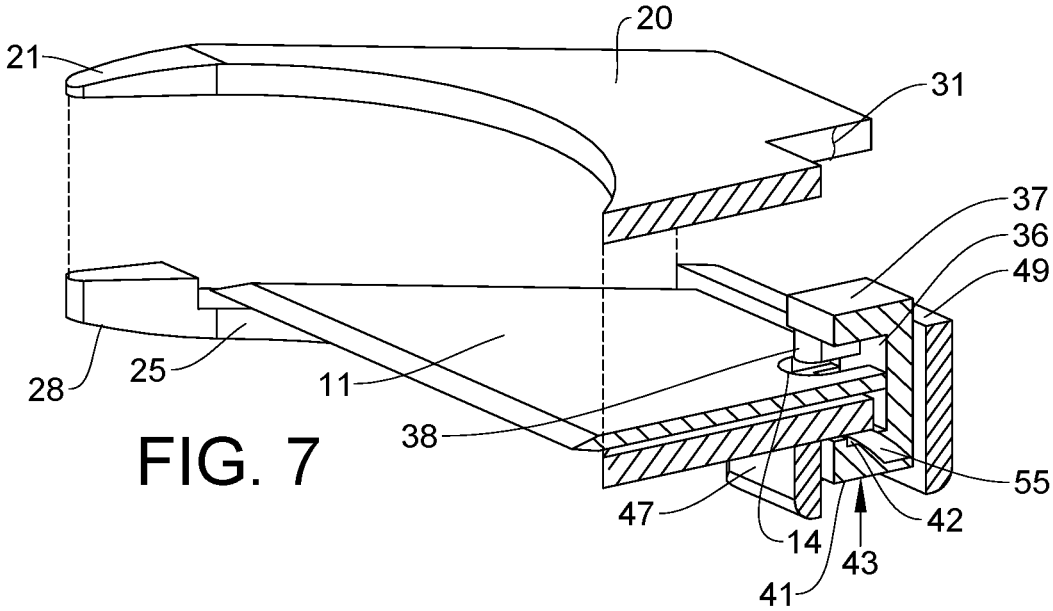
FIG. 7 is a fragmental sectional perspective view of Utility Blade Tapered Nosing Cutting Tool blade holder assembly linear utility blade restraint mechanism in the actuated/unlocked position; utility substantially-planar first part is displaced for visual clarity.

The utility linear spring (55) is nested into a rectangular recess (42) in the engagement piece base portion (41) as shown if FIGS. 6 and 7 and provides a resistive force to keep the engagement piece in the unactuated/blade restrained position of FIGS. 5 and 6. The utility linear spring may be different in type, shape or size as that shown in the figures. When user force is applied to the engagement piece base portion at its distal side (43) shown by the arrow in FIG. 7, the spring compresses and its ends move outwards within the piece rectangular recess (42) allowing the engagement piece to move to the actuated/blade release position as shown in FIG. 7. The utility blade engagement projections (38) are now not aligned with the blade detents (14) and thus this action disengages the engagement projections from the blade detents permitting the blade to be extracted.

Note the substantially-planar first part (20) is displaced and blade and linear restraint parts are sectioned while the utility linear spring (55) is not sectioned in FIGS. 6 and 7 to provide a clearer depiction of spring deflection. Also, because the engagement piece is sectioned, only one utility blade engagement projection (38) is shown.

The engagement piece dimensions and materials of construction should be consistent with the utility projections restraining the blade and thus with sufficient strength to accomplish restraint during tool use. The engagement piece side portion (36) should be of a dimension to allow the engagement projections (38) to be completely out of alignment with the blade detents (14) plus a margin allowing for blade movement in the actuated position shown in FIG. 7. The linear utility restraint housing should be of such dimensions to constrain the engagement piece (35) yet allow for linear movement within the range required for motion described by FIGS. 6 and 7.

The linear restraint housing may be manufactured separately from blade holder parts and attached to these parts after engagement piece with spring is placed into position at the recessed second part void. The housing may be mechanically attached and/or adhesively bonded to the recessed second part where they meet.

A handheld cutting tool employing the linear utility blade restraint mechanism is the subject of independent claim 1.

Figure 8:
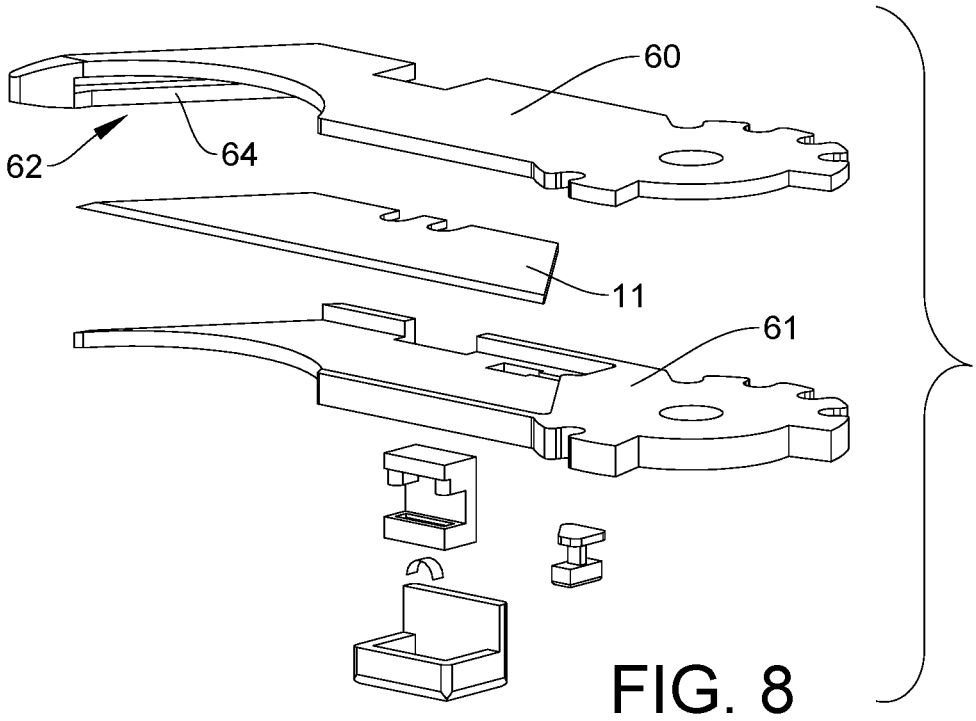
FIG. 8 is an exploded perspective view of the Utility Blade Tapered Nosing Cutting Tool blade holder assembly alternative embodiment.
Figure 9:
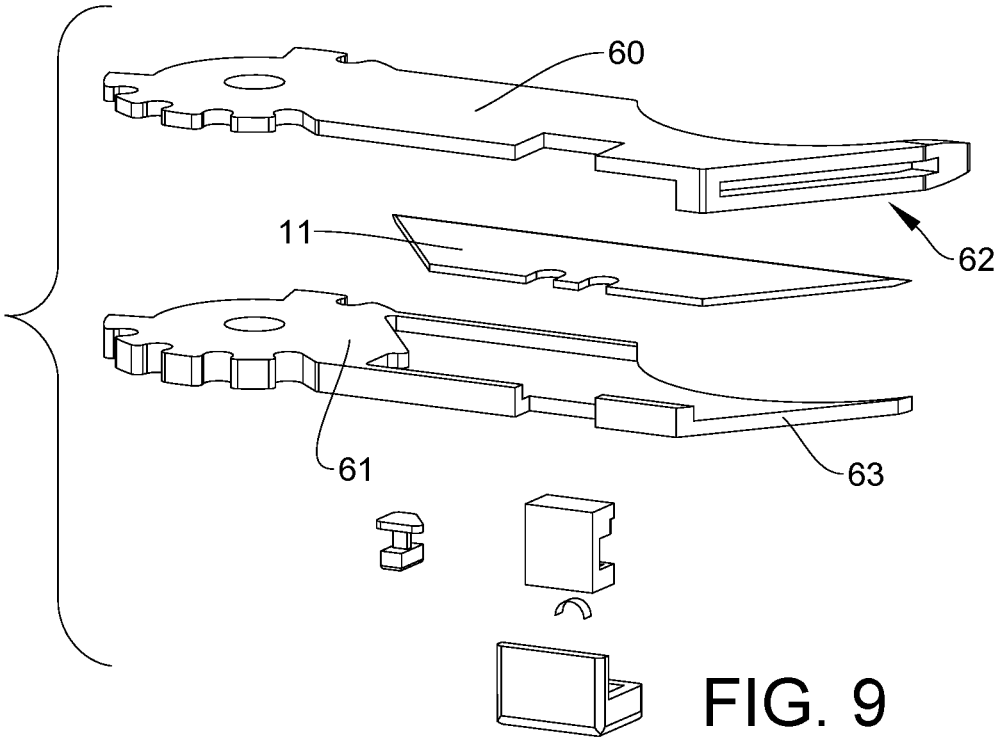
FIG. 9 is an alternate exploded perspective view of the Utility Blade Tapered Nosing Cutting Tool blade holder assembly alternative embodiment.

Referring to FIGS. 8 and 9: An alternative utility tapered nosing substantially-planar first part (60) and the alternative utility tapered nosing recessed second part (61) are formed such that the entire blade holder tapered nosing (62) of the cutting tool blade holder is integrally formed with the alternative substantially planar first part (60) which may provide for additional strength of the nosing using some materials of manufacture such as more rigid metals for the planar first part as a non-limiting example. The alternative utility recessed second part (61) is accordingly reduced in form and mates with the alternative utility generally planar first part. The alternative second part edge (63) can be, again as a non-limiting example, adhesively and/or mechanically bonded to the alternative planar first part nosing portion inner edge (64) adjacent to it.

The following paragraphs [0018] through [0030] present cutting tool material previously disclosed in application Ser. No. 17/704,935 and is presented here to provide context for the utility blade holder and blade restraint of the current application.

Figure 10:
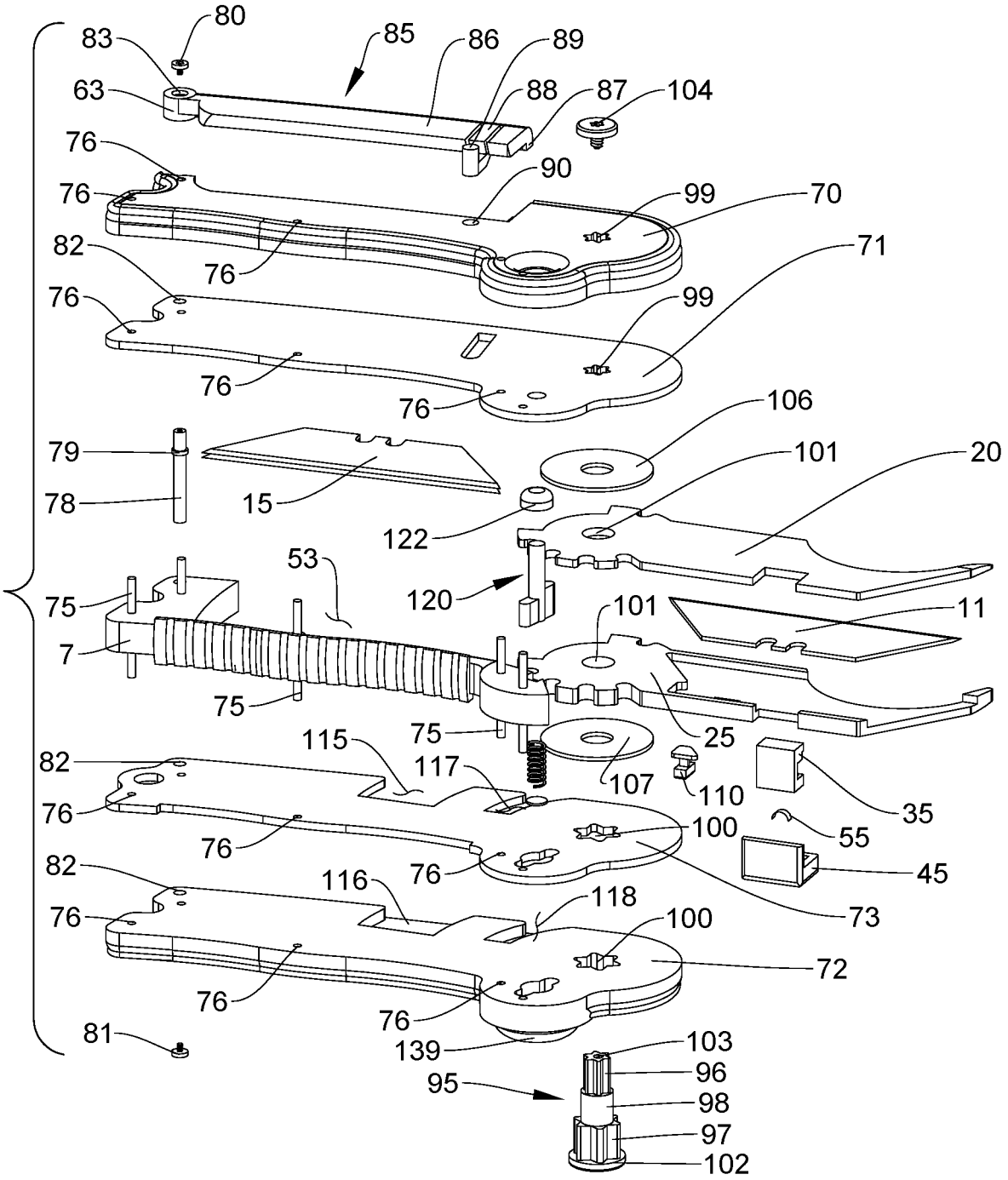
FIG. 10 is an exploded perspective view of the Utility Blade Tapered Nosing Cutting Tool.
Figure 11:
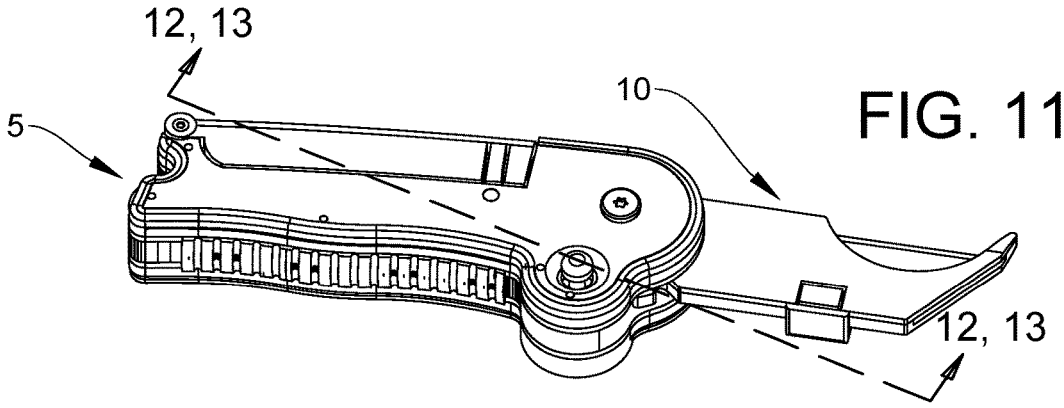
FIG. 11 is a perspective view of Utility Blade Tapered Nosing Cutting Tool defining sections 12 and 13.

Referring to FIG. 10: The utility handle body first half portion is comprised of a utility first contoured outer layer (70) and a utility first substantially-planar inner layer (71). Likewise, the utility handle body second half portion is comprised of a utility second contoured outer layer (72) and a utility second substantially-planar inner layer (73). The contoured outer layers (70, 72) are more complex shapes with filleted edges, recesses, voids, openings and indents. The substantially-planar inner layer portions (71, 73) ordinarily lack filleted planar edges and are formed from materials primarily selected for considerations of strength and flexural resistance. All layers have openings formed to allow for fastener and coupling use. Additionally, the openings, recesses and indents placed in layers accommodate various tool elements. Both contoured outer layers have radiused planar edges to provide a handle shape which promotes proper user holding. The first contoured outer layer (70) is further modified to provide space for spare utility blades (15) and for a spare blade compartment cover (85). The utility handle body center portion (7) placed between the first and second half portions is formed to provide a center space (53) for the blade holder assembly in the retracted position. The body center portion (7) optionally provides a ribbed surface to facilitate a sure grip. These portions may be fabricated of materials as required for particular applications.

The utility handle body center portion and first and second half portion's constituent layers are aligned and constrained by a plurality of cylindrical fasteners (75) and two different couplings to form the handle body. The cylindrical fasteners (75) are placed at any point of manufacture and may be joined to and serve to join any or all layers using an adhesive bond as a non-limiting example. All layers have openings (76) to receive these cylindrical fasteners. The fasteners are shown in FIG. 10 inserted into provided body center portion openings and may vary in length as required by handle body proportions. The number of cylindrical fasteners and thus openings may vary; they are not all referenced in the drawings for visual clarity. The distal handle body area, that is the area away from the blade holder assembly, is constrained by a two-sided flanged coupling (78) that possesses threaded recesses at both ends, an integrally connected flange (79) and by threaded fasteners (80, 81) at either end of the flanged coupling. The coupling is placed through openings (82) in all layers except first contoured outer layer (70) and must be inserted after all layers are placed from a specific inner layer (71) side. The coupling portion between the flange (79) and threaded fastener (81) serves to join and constrain all layers except the utility first contoured outer layer (70). The flanged coupling portion between the flange (79) and threaded fastener (80) serves to attach the spare blade compartment cover (85) while allowing for its rotation and thus access to the compartment. The spare blade compartment cover (85) and second contoured outer layer (72) are given fastener cylindrical recesses (83) to accommodate the threaded fasteners (80, 81, respectively).

The spare blade compartment cover (85) has a generally planar portion (86) and an integrally connected orthogonal portion (87) perpendicular to the planar portion (86); both are shaped so as to align with the form of the utility first contoured outer layer (70) adjacent to it. The planar portion (86) and the outer layer (70) are shaped so as to provide space to accommodate spare blades (15). The blade compartment cover portion in line with the longitudinal axis of the two-sided flanged coupling (78) has a coupling recess which penetrates the cover to receive the coupling (78) and a fastener cylindrical recess (83) at its surface to accommodate the threaded fastener (80). This recess to receive the two-sided flanged coupling is of a size to permit rotational motion without excessive non axial movement and is concentric with the fastener cylindrical recess (83); it is not visible in the drawings. The spare blade compartment cover thus can rotate about the longitudinal axis of the two-sided flanged coupling to an angle which permits access to the spare blades. Additionally, the spare blade compartment cover has a locking mechanism consisting of a flat rectangular portion (88) separated from the cover body except where it is joined to the orthogonal portion (87), a cylindrical portion (89) to align with and be constrained by a matching hole (90) in the first contoured outer layer (70) when the cover is closed and locked. Depressing the flat rectangular portion (88) at a point away from where it is joined to the orthogonal portion (87) disengages the cylindrical portion (89) from the outer layer hole (90) permitting release of the lock and rotation of the cover. The spare blade compartment cover should be fabricated of a sufficiently pliant yet ductile material to permit this locking mechanism to function properly.

The handle body and its constituents and the blade holder assembly are operably connected by a coupling. As a non-limiting element, an axially aligned coupling is presented with these cutting tool embodiments. This axially aligned coupling is the subject of a U.S. Utility Pat. No. 11,326,632 B1/non-provisional patent application Ser. No. 17/567,319 submitted by the same sole inventor as this application. The use of the axially aligned coupling improves the operation and assembly of the cutting tool embodiments presented, but the axially aligned coupling is an optional element of the cutting tools. Other fastener types may be used in lieu of the axially aligned coupling.

Referring to FIG. 10: The axially aligned coupling body (95) has the following characteristics and constraints. The coupling has a longitudinal center axis along which portions whose normal section plane shape varies as required by their function. The first (96) and second (97) portions of the coupling are designed to have peripheral assembly components adjacent to them where no movement or rotation is desired. As such, a complex, non-circular shape for this coupling section is required. The shapes that achieve this result most effectively are generally but not exclusively complex, concave polygons. For the center portion (98), the coupling is shaped as a cylinder so as to allow adjacent components to rotate about the coupling center axis.

The various axially aligned coupling portion shapes are matched with radially adjacent components containing an opening whose shape is the negative of the adjacent coupling portion in section. This arrangement serves to provide forces opposing rotation of the assembly parts about the coupling axis first (96) and second (97) portions. The coupling portions provide forces directly opposing the assembly components openings minimizing slippage, disengagement or grinding type failures. For layer portions (70, 71) adjacent to axially aligned first portion (96) after tool assembly, the layer openings (99) substantially match the first coupling portion (96) shape. For layer portions (72, 73) adjacent to axially aligned second portion (97) after tool assembly, the layer openings (100) substantially match the second coupling portion (97) shape. The blade holder assembly constituents (20, 25) are given a circular opening (101) of the same approximate diameter as the coupling center portion (98) so as to allow the blade holder assembly to rotate. The axially aligned coupling has a cylindrical end cap (102) integrally connected to the coupling second portion (97) and an internally threaded recess (103) at the opposite end to receive an externally threaded fastener (104). Recesses in the body outer layers (70, 72) to accommodate the cylinder end cap (102) and fastener (104) may be provided but are not shown in FIG. 10.

The axially aligned coupling can be placed from the handle body second contoured outer layer (72) side after all layer portions, blade holder elements and friction washers (106, 107) are aligned, serially placed and conjoined whereupon the externally threaded fastener (104) is placed in the internally threaded recess (103). The axially aligned coupling now constrains the handle body constituent layers together, permits blade holder assembly rotation and thus operationally connects the blade holder assembly to the handle body.

A utility blade ejector (110) serves to drive the blade out of the blade holder when required for blade change thus diminishing injury risk to the user. It is inserted into the wide portion of an opening (111, FIGS. 3 and 4 only) provided in the recessed second part (25) at a 90-degree angle during manufacture and before blade holder assembly. Once inserted and rotated 90 degrees to its normal position and the blade holder portions are joined, it is restrained from movement other than linearly along its track to exert force on the blade side to partially eject it for replacement. The utility blade ejector portion that contacts the blade side (112, FIG. 4 only) is angled causing the portion of the ejector placed between blade holder parts to be shaped as a trapezoid to ensure maximum contact with the blade and provide linear blade movement.

With the blade holder assembly in the retracted position, the blade restraint and the blade ejector mechanisms both interfere with some handle body second portion layers (72, 73) and as such those layers must be modified with recesses and voids. The blade restraint is harmonized with the layer portions by adding a void (115) and a recess (116) and the blade ejector is harmonized by adding a void (117) and a recess (118). Forming these blade restraint and ejector as smaller elements would obviate the need for these recesses.

Referring to FIGS. 10-13: The blade holder rotation control assembly is described. The rotation control assembly is essentially the same assembly for all presented cutting tool embodiments; the rotation control assembly is presented using the Utility Blade Tapered Nosing Cutting Tool as representative of all presented cutting tool embodiments.

The blade holder rotation assembly is comprised a pinning component (120) with connected push button (122), a spring element (130), a pinning component restraint piece (135) and a plurality of detents (129, not all referenced) along the periphery of the blade holder most proximate to the pinning component. Depressing the push button actuates the mechanism permitting the blade holder assembly to rotate about the axis of the axially aligned coupling. Note that in FIG. 12 the pinning component restraint piece (135) is displaced and rotated and in FIG. 13 it is displaced—both to provide visual clarity. Rotation control assembly elements are not sectioned in either FIG. 12 or 13 to better describe their operation.

Figure 12:
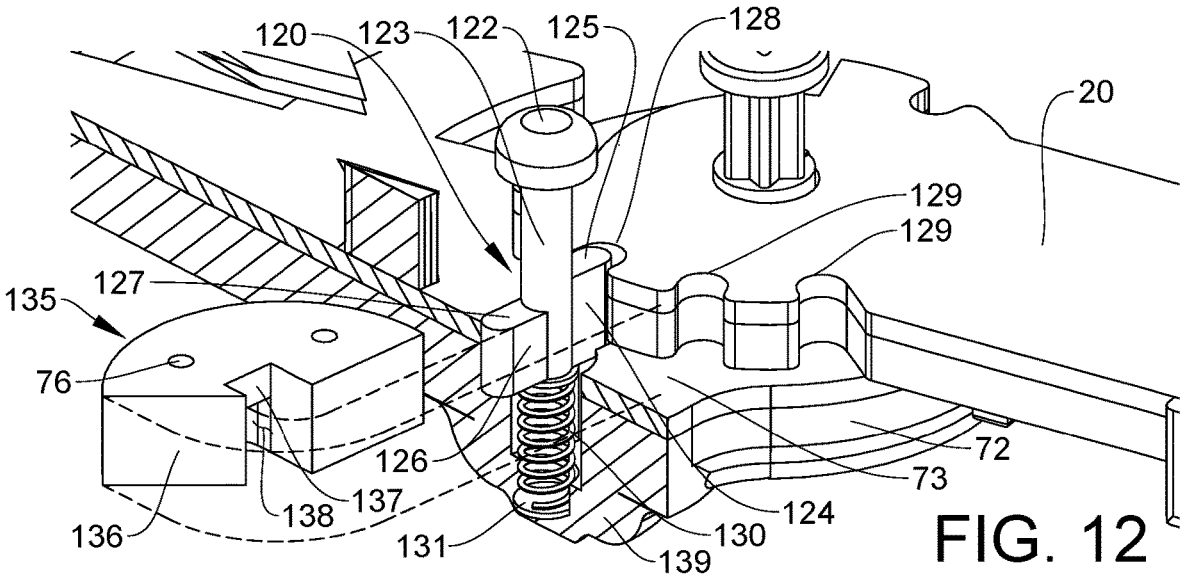
FIG. 12 is a fragmental sectional perspective view of Utility Blade Tapered Nosing Cutting Tool blade holder rotation control assembly in the unactuated/locked position; pinning component restraint is displaced and rotated for visual clarity.
Figure 13:
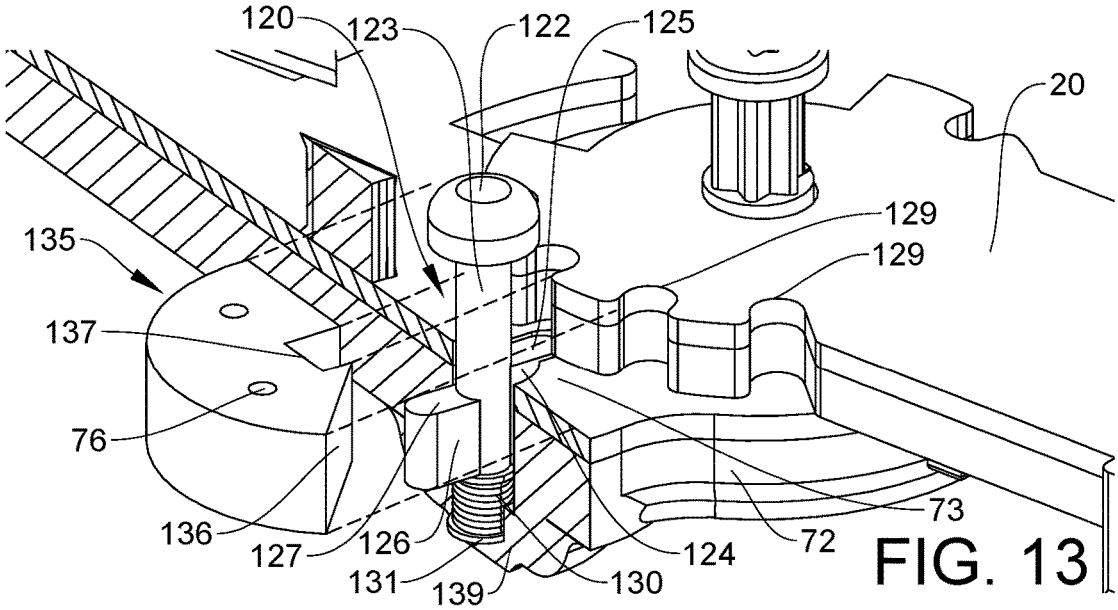
FIG. 13 is a fragmental sectional perspective view of Utility Blade Tapered Nosing Cutting Tool blade holder rotation control assembly in the actuated/unlocked position; pinning component restraint is displaced for visual clarity.

Referring to FIGS. 12-13: The pinning component (120) is comprised of a center cylindrical portion (123) with integrally connected projecting first and second portions (124, 126) having a form of, as a non-limiting example, a substantially rectangular elements with ovalized shape away from the center cylindrical portion. The projecting first portion (124) interfaces with the blade holder parts. This portion (124) is connected to the center cylindrical portion (123) so that its flat portion (125) generally aligns with the adjacent (128) blade holder planar first part (20) when the button is not actuated as shown FIG. 12. This is the locked position. When the push button (122) is depressed, the spring element (130) is compressed and the entire pinning component (120) is displaced along its longitudinal axis so that the first flat portion (125) now aligns with the adjacent handle body second substantially-planar inner layer (73). The pinning component is now not engaged with the blade holder detent thus permitting the blade holder assembly to rotate freely as shown in FIG. 13. Opposite to the projecting first portion (124) is a projecting second portion (126) which is similar in form but differs in that its placement along the center cylindrical portion (123) is altered to permit interfacing with the pinning component restraint piece (135). The pinning component restraint piece constrains the pinning component resisting both rotational and linear forces applied to the pinning component by the blade holder assembly during tool use. The pinning component restraint piece (135) is formed as a cylinder segment flattened on two sides, one of which-side (136)—serves to limit blade holder assembly travel in the unlocked position. The pinning component restraint piece (135) has a substantially rectangular recess (138, FIG. 12) formed to accommodate the pinning component projecting second portion (126) and a restraint projection (137) at this recess to constrain and limit the pinning component travel along its longitudinal axis. The pinning component second connected portion flat portion (127) comes into contact with the base of the restraint projection (137) in the locked position to provide this limit. The pinning component restraint has openings (76) to permit conjoining to the handle body portions using the previously discussed cylindrical pins (75; not shown in FIGS. 12 and 13).

The pinning component (120) is held at its proper alignment by a spring element (130), a helical compression spring shown in the drawings as non-limiting example, and which may have a generally flat cylindrical element (131) connected at either end to provide strength and stability to the spring operation. Other force resisting devices or spring types may be used in place of the helical spring. The top flat cylindrical element is not referenced in the drawings for clarity. As shown in FIGS. 10, 12, and 13, voids and recesses in both first and second half layer portions and a projection (139) from second contoured outer layer (72) form a housing for the spring and rotation control elements. The projection also possesses a recess to house the spring element.

The Razor Blade Tapered Nosing Cutting Tool principal elements, aspects of which were previously presented in application Ser. No. 17/704,935, are now described and referenced in paragraph [0032] of this section. Portions of the cutting tool modified by new material or otherwise improved over the cutting tools presented in application Ser. No. 17/704,935 are presented and referenced in portions of paragraph [0032] and paragraphs [0033] through [0043] of this section. More detailed aspects of the Razor Blade Tapered Nosing Cutting Tool previously disclosed by Ser. No. 17/704,935 are described and referenced in paragraphs [0045] through [0048].

Figure 14:
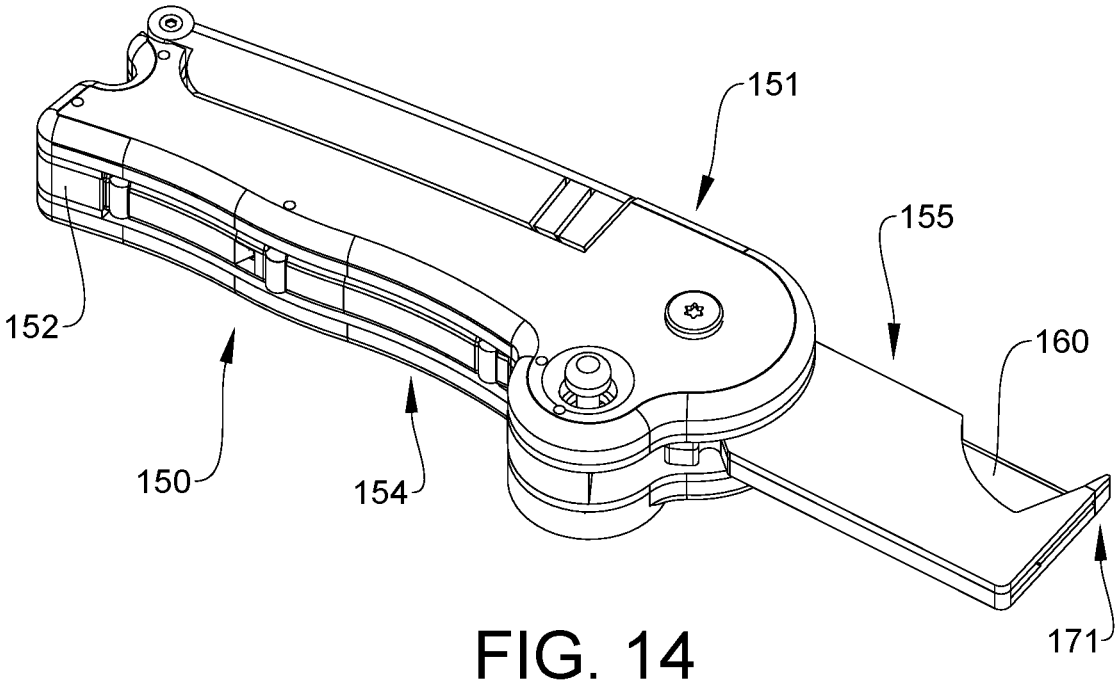
FIG. 14 is a perspective view of Razor Blade Tapered Nosing Cutting Tool with linear razor blade restraint mechanism.
Figure 15:
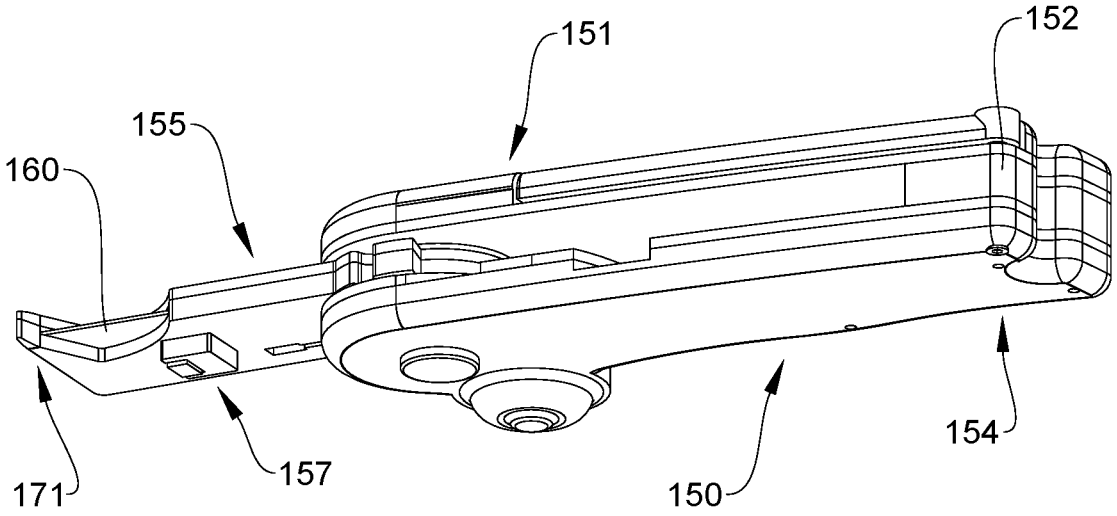
FIG. 15 is an alternate perspective view of Razor Blade Tapered Nosing Cutting Tool with linear razor blade restraint mechanism.

Referring to FIGS. 14 and 15: The Razor Blade Tapered Nosing Cutting Tool presented is comprised of a razor handle body (150) and a razor tapered nosing blade holder assembly (155). The razor handle body is further comprised of a razor body first half portion (151), razor body center portion (152) and razor body second half portion (154) which are placed together to form a razor handle body to house and deploy and constrain a razor tapered nosing blade holder assembly (155) and standard single edge razor blade (160). The razor body first half portion (150), razor body center portion (152) and razor body second half portion constituents (154) are presented with ornamentally different filleting and the ribbed elements of the center portion removed to illustrate an embodiment of a tool which for some may be more comfortable to hold. The Razor Blade Tapered Nosing Cutting Tool blade holder rotation control assembly is formed and functions as that of the utility blade cutting tool. Additionally, the fasteners, couplings and spare blade compartment cover are also as with the utility blade tool. Therefore, these aspects of the razor blade tools will not be repeated and only differences from the utility blade tool will be described. The razor blade tool handle body portions and their constituent layer elements have been given different reference numbers to differentiate them from those of the utility blade tool handle body. The spare blade compartment now stores two spare single edge razor blades.

Referring to FIGS. 14-17: The Razor Blade Tapered Nosing Cutting Tool razor tapered nosing blade holder assembly (155) is comprised of a razor tapered nosing substantially-planar first part (170) and a razor tapered nosing recessed second part (175) which possesses a razor blade tapered recess (176) in the approximate shape of a standard rectangular single edge razor blade. As with the utility tool, the depth of this recess should be selected so as to prohibit excessive movement of the razor blade orthogonal to its thin dimension. The recessed second part blade recess is open (177) on the distal side of the blade holder and partially open adjacent to the razor blade cutting edge (161). The recessed second part possesses a blade stabilizing projection (179) at the proximal end of the recess (176) which nests inside the razor blade proximal side detent (163) when the blade is in the restrained position. This projection (179) serves to prevent blade rotational motion during blade use. Additionally, the blade recess depth is increased in the portion (174) corresponding to areas where the blade is reinforced (166) to position the blade generally parallel to the recessed second part and to facilitate blade stability during tool use. When both razor blade holder parts are joined, these parts constrain the blade except as to allow movement (extraction) linearly towards where the recessed second part recess is open (177). As previously described, this blade holder design permits, when used blade edge up and with motion generally away from the user, cutting planar materials without damaging materials not intended to be cut by virtue of isolating the materials to be cut from the point of the blade.

Referring to FIG. 14-17: The Razor Blade Tapered Nosing Cutting Tool razor tapered blade holder assembly nosing (171) and the linear razor blade restraint mechanism (157; FIG. 15) for this razor tool are different from those of other previously presented cutting tools and are disclosed and referenced here. The razor tapered blade holder nosing (171) is comprised of the razor tapered nosing substantially-planar first part nosing (172) and razor tapered nosing recessed second part nosing (173).

Figure 16:
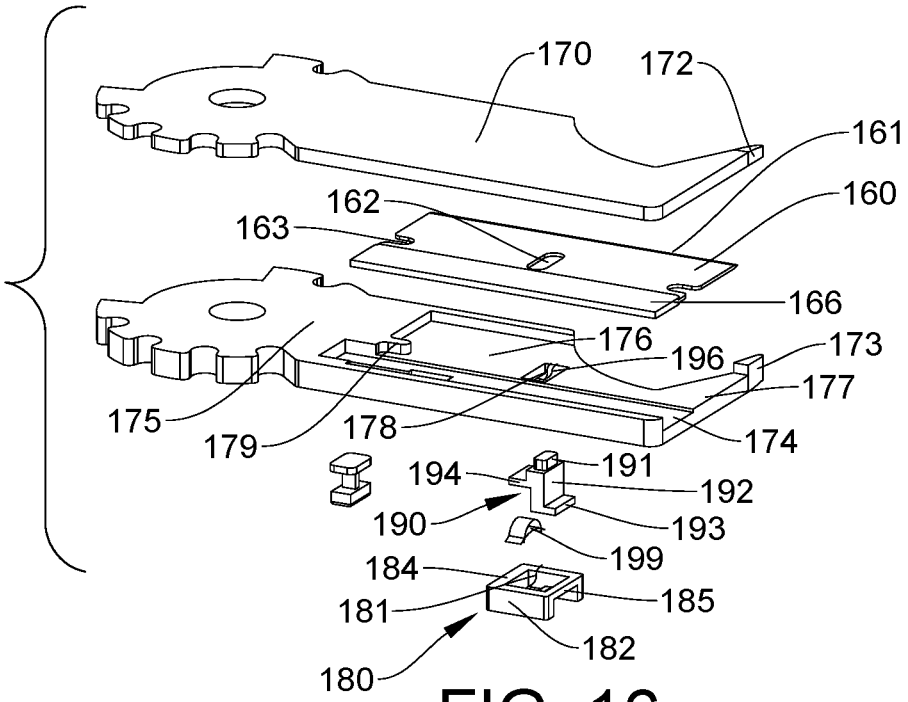
FIG. 16 is an exploded perspective view of the Razor Blade Tapered Nosing Cutting Tool blade holder assembly and linear razor blade restraint mechanism.
Figure 17:
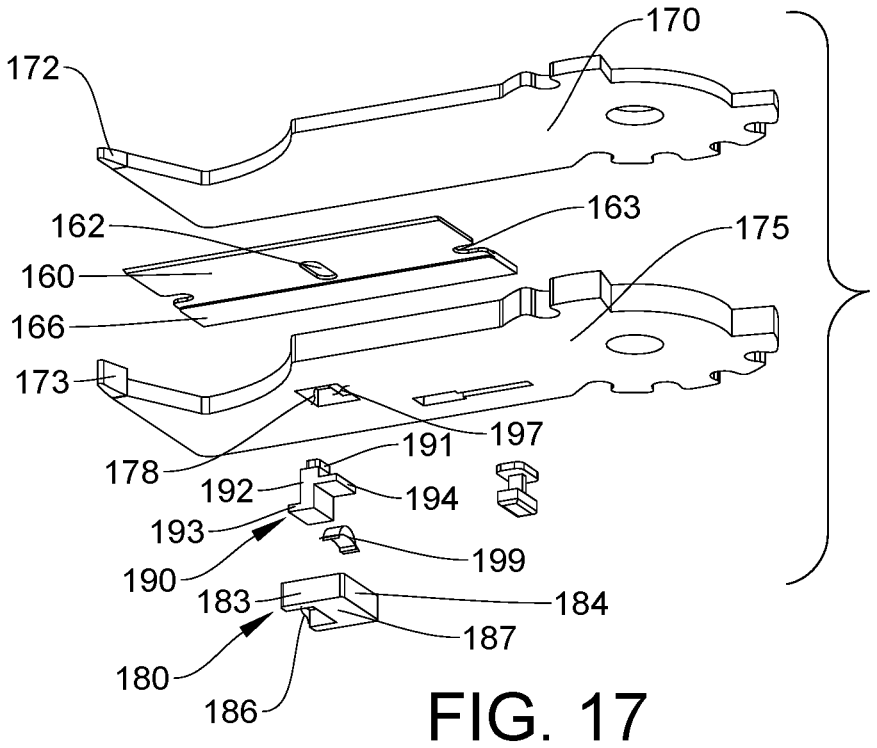
FIG. 17 is an alternate exploded perspective view of the Razor Blade Tapered Nosing Cutting Tool blade holder assembly and linear razor blade restraint mechanism.
Figure 18:
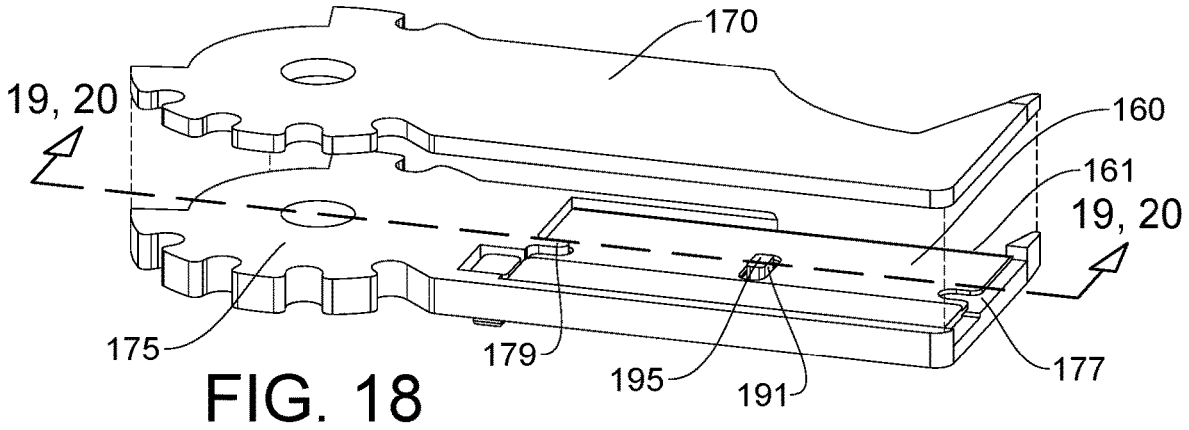
FIG. 18 is a perspective view of Razor Blade Tapered Nosing Cutting Tool defining sections 19 and 20. Razor tapered nosing substantially-planar first part is displaced for visual clarity.
Figure 19:
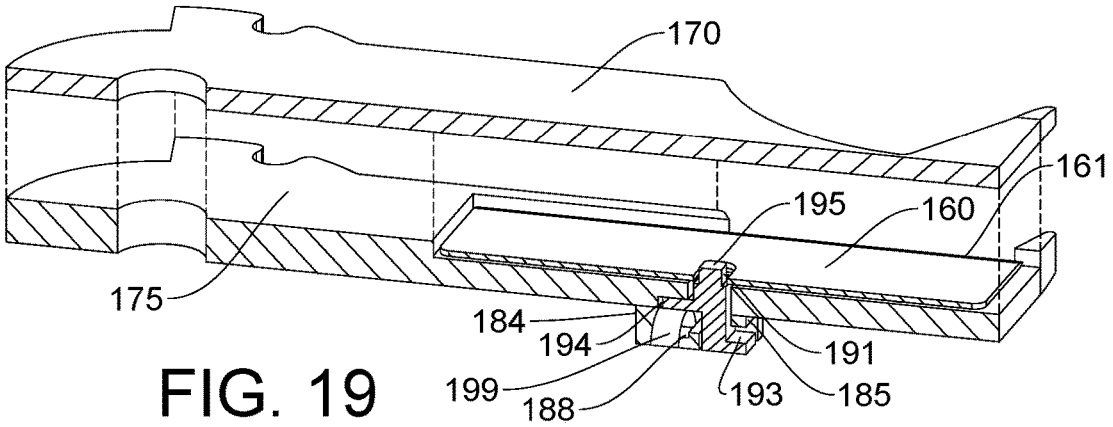
FIG. 19 is a fragmental sectional perspective view of Razor Blade Tapered Nosing Cutting Tool blade holder linear razor blade restraint mechanism in the unactuated/locked position; razor tapered substantially-planar first part is displaced for visual clarity.

Referring to FIG. 16-20: The Razor Blade Tapered Nosing Cutting Tool linear razor blade restraint mechanism is comprised of a linear restraint void (178) in the recessed second part (175), a linear razor restraint housing (180) placed at the non-blade side of the razor recessed second part linear restraint void (178), a linear razor blade engagement piece (190) and a razor linear spring (199). The linear razor blade engagement piece (190) has a single linear razor blade engagement projection (191) which engages the razor blade center opening (162) preventing blade movement when the mechanism is in the unactuated position as shown in FIGS. 18 and 19. The razor linear spring (199) provides a resistive force to oppose movement of the engagement piece to the actuated position shown in FIG. 20 and is shown in both the compressed and uncompressed state in FIGS. 16 and 17. The razor tapered nosing recessed second part (175) and linear restraint housing (180), when joined, constrain the linear razor blade engagement piece to generally linear movement as described by FIGS. 19 and 20.

The linear razor restraint housing (180) is a generally rectangular element with an open area (181) aligning with the razor tapered nosing recessed second part linear restraint void (178), two longitudinal sides (182, 183), a transverse side (184) and an optional connection bar (185). The housing additionally is formed of an open area (186) at the portion of the housing furthest from the blade holder, that is its base, and an adjacent planar base portion (187; FIG. 17 only). The non-base side of the planar portion possesses a rectangular spring recess (188, shown if FIGS. 19 and 20 only) to accommodate the razor linear spring (199).

The linear razor blade engagement piece (190) is comprised of a main body (192), a linear razor blade engagement projection (191), which may be in the shape of the single edge razor blade center opening (162) and integrally formed to the main body (192) of the engagement piece, a linear pull portion (193), and a spring contact portion (194). The linear pull portion (193) is generally planar, orthogonal to and integrally formed with the main body (192). The spring contact portion (194) is generally planar, orthogonal to and integrally formed with the main body of the engagement piece (190) opposite the linear pull portion and proceeding towards the proximal portion of the blade holder. The distance from the base of the engagement projection (191), that is where it is connected to the main body of the engagement piece, to the non-blade holder side of the spring contact portion (194) generally coincides with the thickness of the razor tapered nosing recessed second part (175) at the void (178). The razor linear spring (199) is formed and placed in the linear housing rectangular spring recess (188) such that in the unactuated position the center of the spring comes into with the non-blade holder side of the spring contact portion (194).

The linear restraint void (178) is formed by combining a smaller void (196; FIG. 16 only) and an adjacent recess (197; FIG. 17 only); the smaller void (196) in the approximate size of the linear engagement piece main body portion between base of the linear razor blade engagement projection (191) and the spring contact portion (194). The adjacent recess (197; FIG. 17, 20), is in the approximate size of the spring contact portion and is placed aligned with the recessed second part non-blade side. The spring contact portion (194) nests in this adjacent recess (197) when the mechanism is in the unactuated position and blade side of the adjacent recess limits the movement of the linear engagement piece, both as shown in FIG. 19.

The engagement main body is of such a length that the linear pull portion (193) at its base sits generally aligned with the distal plane of the linear razor restraint housing open area (186) and thus the distal plane of the housing planar base portion (187; FIG. 17 only).

In the unactuated position shown by FIGS. 18 and 19, razor linear spring applies a force to the base of the spring contact portion maintaining the engagement projection (191) nested into the razor blade center opening (162) restraining the blade. The razor linear spring may be different in type, shape or size as that shown in the figures.

Figure 20:
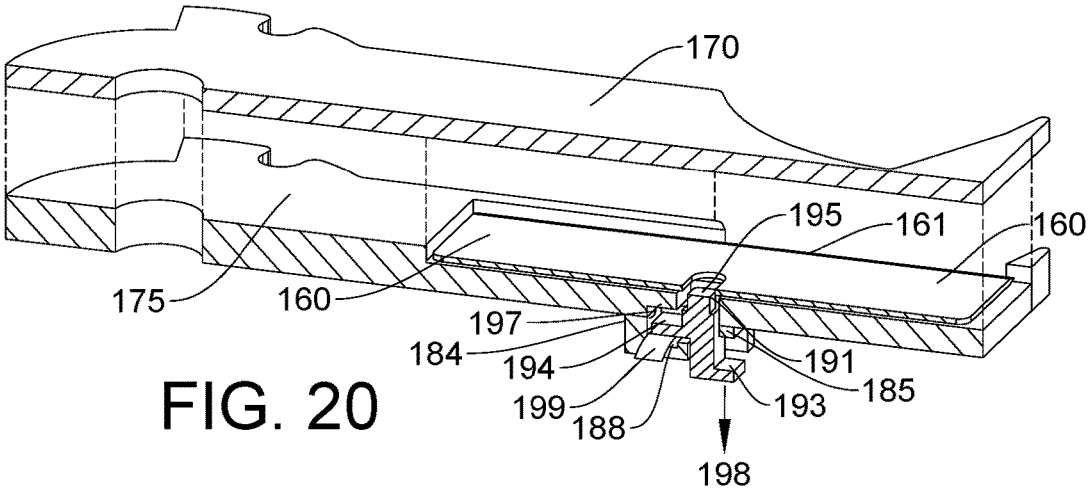
FIG. 20 is a fragmental sectional perspective view of Razor Blade Tapered Nosing Cutting Tool blade holder linear razor blade restraint mechanism in the actuated/unlocked position; razor tapered substantially-planar first part is displaced for visual clarity

When a user pulling force (198, arrow in FIG. 20) is applied to the blade side of the linear blade restraint engagement piece (190) linear pull portion (193), the linear spring compresses, its ends move outward, still within the spring recess (188), and the linear engagement piece engagement projection (191) retracts bringing its flat portion (195) aligned with or below with the surface of the blade holder recessed second part tapered recess (176) as shown in FIG. 20 permitting the blade to be extracted. The linear razor restraint housing (180) constrains the blade engagement piece so that it moves only in the direction of spring compression and limits its amount of travel. Also, the housing spring recess (188) base may be optionally curved (not shown) to provide improved spring operation. Note the planar first part (170) is displaced and all the blade holder parts shown are sectioned in FIGS. 19 and 20 except the linear spring which is not sectioned to provide a clearer depiction of spring deflection. Construction of the blade holder assembly may be facilitated by forming the linear razor restraint housing (180) as a separate element and attaching to the blade holder recessed second part mechanically and/or adhesively after placement of the engagement piece and the razor linear spring in the rectangular recess (188) and prior to housing attachment.

A handheld cutting tool employing the linear razor blade restraint mechanism is the subject of independent claim 2.

Figure 21:
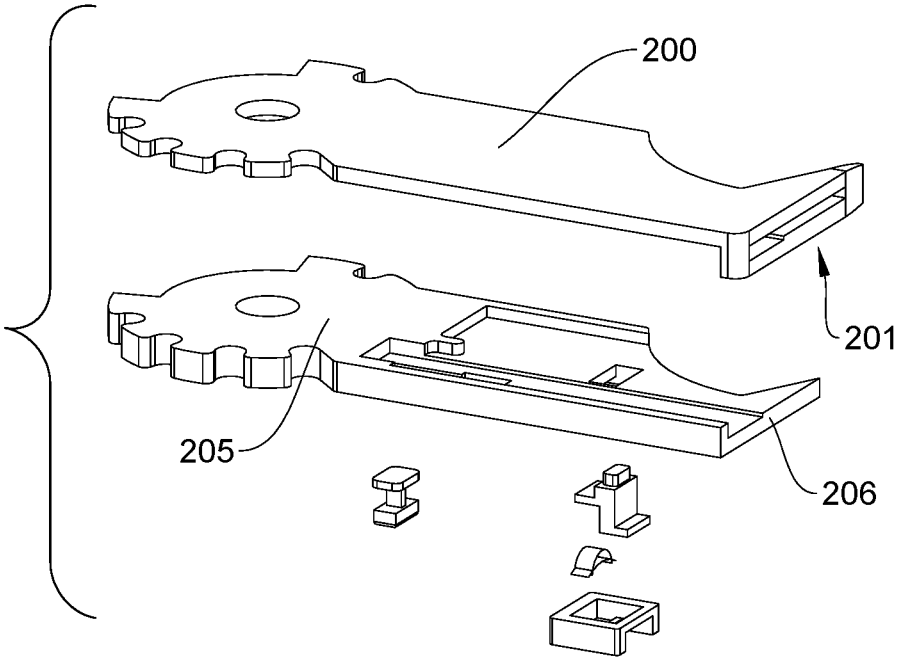
FIG. 21 is an exploded perspective view of the Razor Blade Tapered Nosing Cutting Tool blade holder assembly alternative embodiment.
Figure 22:
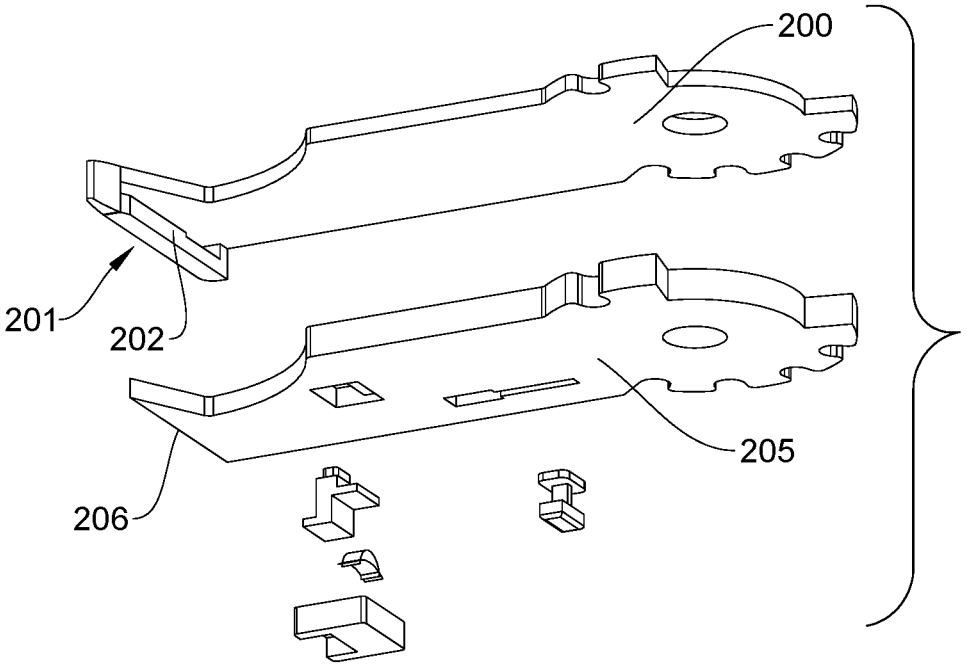
FIG. 22 is an alternate exploded perspective view of the Razor Blade Tapered Nosing Cutting Tool blade holder assembly alternative embodiment.

Referring to FIGS. 21 and 22: Alternative razor tapered nosing substantially-planar first part (200) and the alternative razor tapered nosing recessed second part (205) are formed such that the tapered nosing (201) of the Razor Blade Tapered Nosing Cutting Tool blade holder is integrally formed with the alternative razor tapered nosing substantially-planar first part (200) which may provide for additional strength of the nosing using some materials of manufacture such as more rigid metals for the planar first part. The alternative razor tapered nosing recessed second part (205) is accordingly reduced in form and mates with the alternative substantially-planar first part. Its alternative recessed second part edge (206) can be, as a non-limiting example, adhesively and/or mechanically bonded to the alternative planar first part edge (202).

Again, the following paragraphs [0045] through [0048] describe material previously disclosed in application Ser. No. 17/704,935 referring to razor cutting tools.

Figure 23:
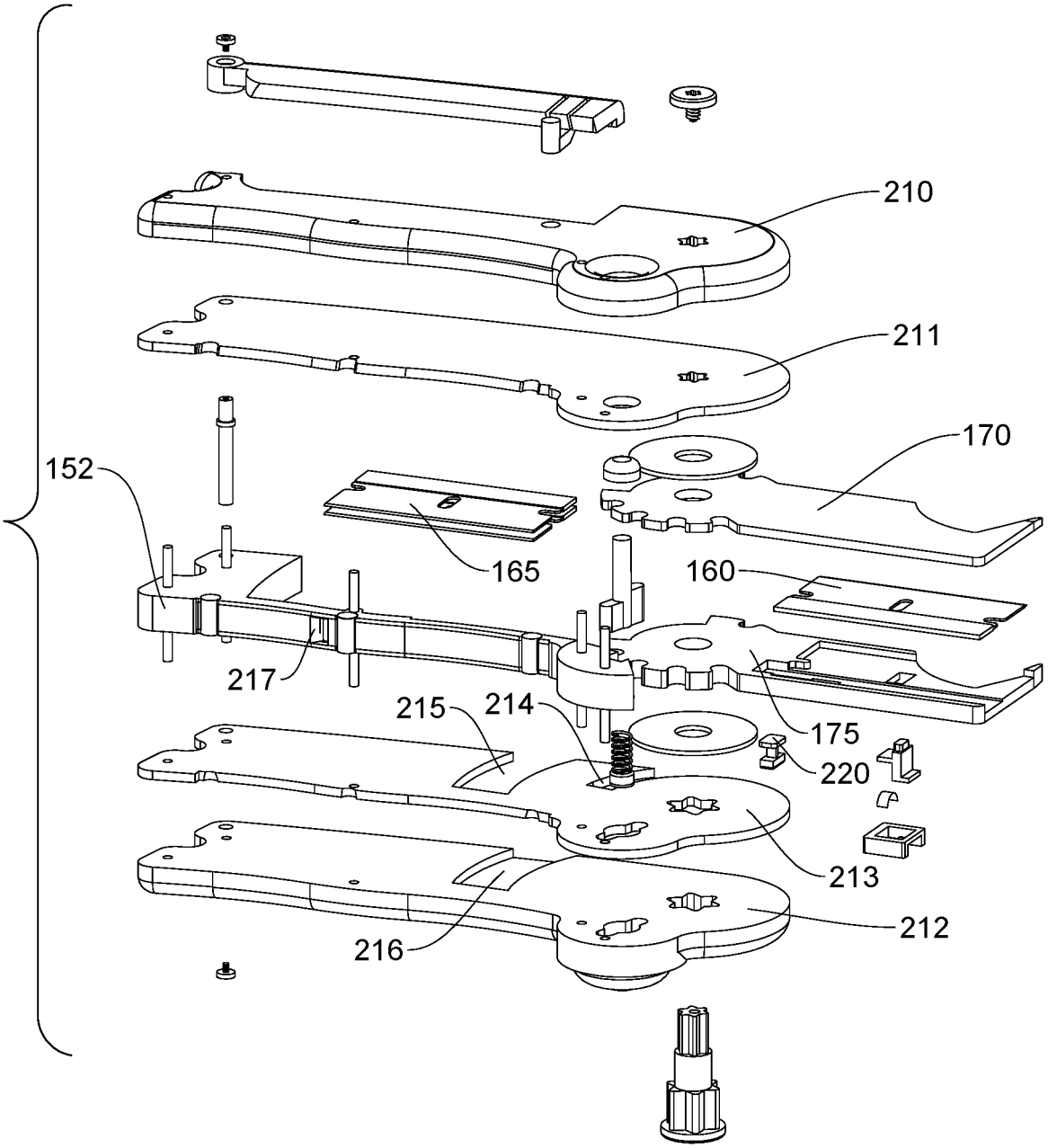
FIG. 23 is an exploded perspective view of the Razor Blade Tapered Nosing Cutting Tool with linear razor blade restraint mechanism.

Referring to FIG. 23: For the Razor Blade Tapered Nosing Cutting Tool the various body layer elements are: a razor first contoured outer layer (210), a razor first substantially-planar inner layer (211), a razor second contoured outer layer (212), and a razor second substantially-planar inner layer (213). They have been given different reference numbers to distinguish the layers from those of the utility tool. A razor blade ejector (220) serves to drive the blade out of the blade holder assembly when required for blade change thus diminishing injury risk to the user. It is inserted into the wide portion of an opening provided in the recessed blade recessed layer element at a 90-degree angle during manufacture and before blade holder assembly. The razor blade ejector portion that contacts the blade side is shaped as a rectangle to ensure maximum contact with the blade and to provide linear blade movement. Once inserted and rotated 90 degrees to its normal position and the blade holder parts are joined, it is restrained from movement other than linearly along its track to exert force on the blade proximal side to partially eject it for replacement. The razor blade ejector is an option element of the razor tool and may be omitted. The razor blade ejector (220) of the razor blade holder assembly can be made of proportions to eliminate the interference with the razor second contoured outer layer (212). Thus, as shown in FIG. 23 the recess in that layer associated with interference has been eliminated. The void (214) in the second substantially-planar inner layer (213) for the blade ejector remains. The void (215) in the second substantially-planar inner layer (213) and the recess (216) in the second contoured outer layer (212) accommodating the razor blade linear restraint mechanism have been moved and enlarged to resolve interference with the razor blade holder assembly during blade holder retraction.

Additionally, the razor body center portion (152) possesses an opening (217) to house the distal end of the blade holder assembly tapered nosing.

Referring to FIGS. 24-27: the rotational functioning of the blade holder assembly and rotational control assembly is described and illustrated using the Razor Blade Tapered Nosing Cutting Tool as representative of both utility and razor type cutting tools. Please note some portions are exploded as indicated by brackets to more clearly show the blade holder/rotational control assembly interface. As previously described the blade holder substantially-planar first part and recessed second part both have a plurality of detents which serve to engage the pinning component first portion and thus the entire rotation control assembly. In the presented embodiment, the blade holder parts have five positions and a detent for each as a non-limiting example of possible configurations. The tool positions are shown as: retracted, FIG. 24; up position, FIG. 25; down position 1, FIG. 26; down position 2, FIG. 27; fully extended, FIGS. 14 and 15. The positions followed by their specific detent reference numbers are given here: retracted (225), up position (226), fully extended (227), down position 1 (228) and down position 2 (229). The varied positions afford the user the ability to make cutting motions at a variety of angles with relation to the plane of the materials to be cut. Both the number and angular positioning of the detents can be optionally modified.

Figure 28:
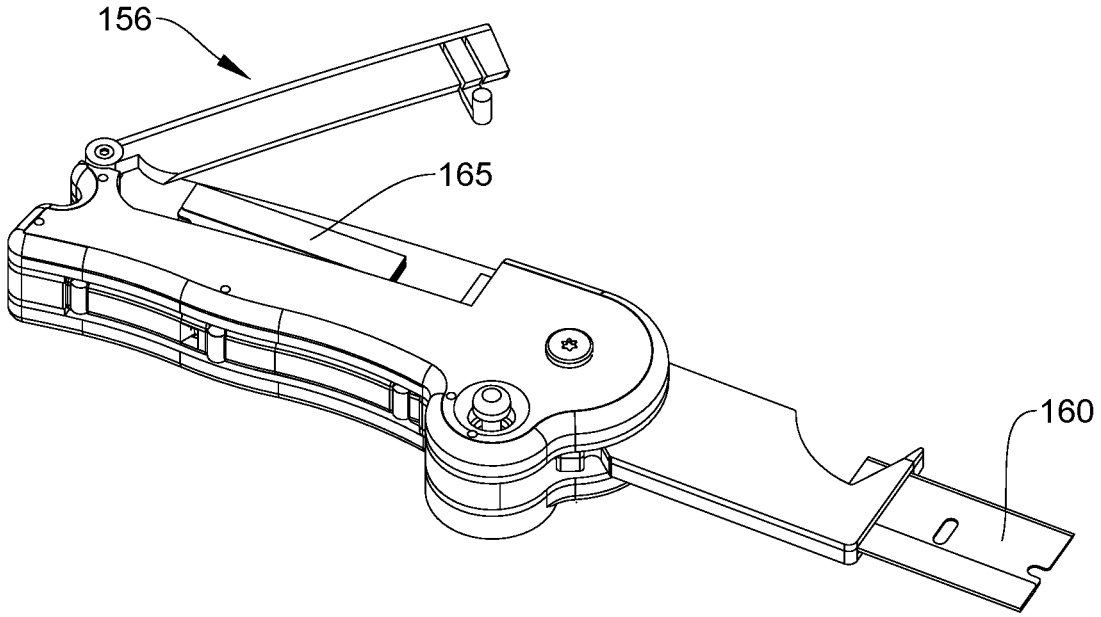
FIG. 28 is a perspective view of the Razor Blade Tapered Nosing Cutting Tool with spare blade compartment cover partially open and razor blade partially removed.
Figure 29:
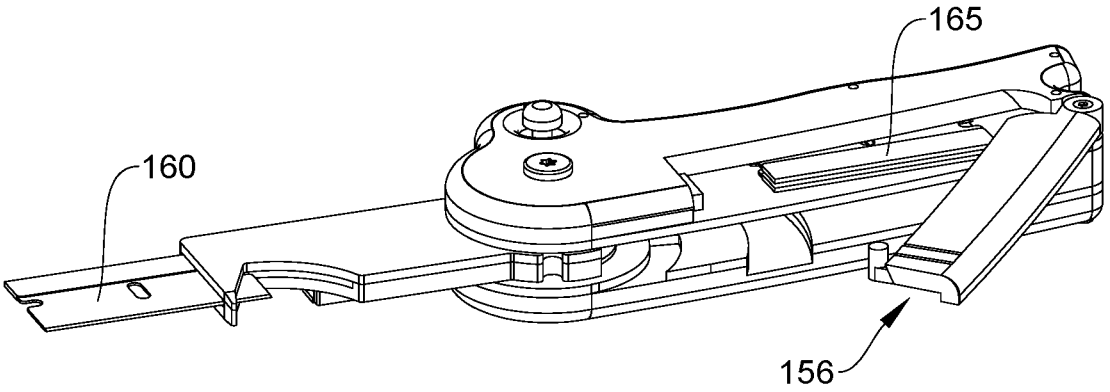
FIG. 29 is an alternate perspective view of the Razor Blade Tapered Nosing Cutting Tool with spare blade compartment cover partially open and razor blade partially removed.

Referring to FIGS. 28 and 29: The previously described Razor Blade Tapered Nosing Cutting Tool embodiment is shown with the razor spare blade compartment cover (156) partially open, the spare blades (165) visible and the razor blade (160) partially ejected from the blade holder assembly.

The Razor Blade Holder Open Cutting Tool principal elements, aspects of which were previously presented in application Ser. No. 17/704,935, are now described and referenced in paragraph [0050]. Portions of the cutting tool modified or improved over the cutting tools presented in application Ser. No. 17/704,935 are disclosed and referenced in paragraphs [0050] through [0087] of this section.

Figure 30:
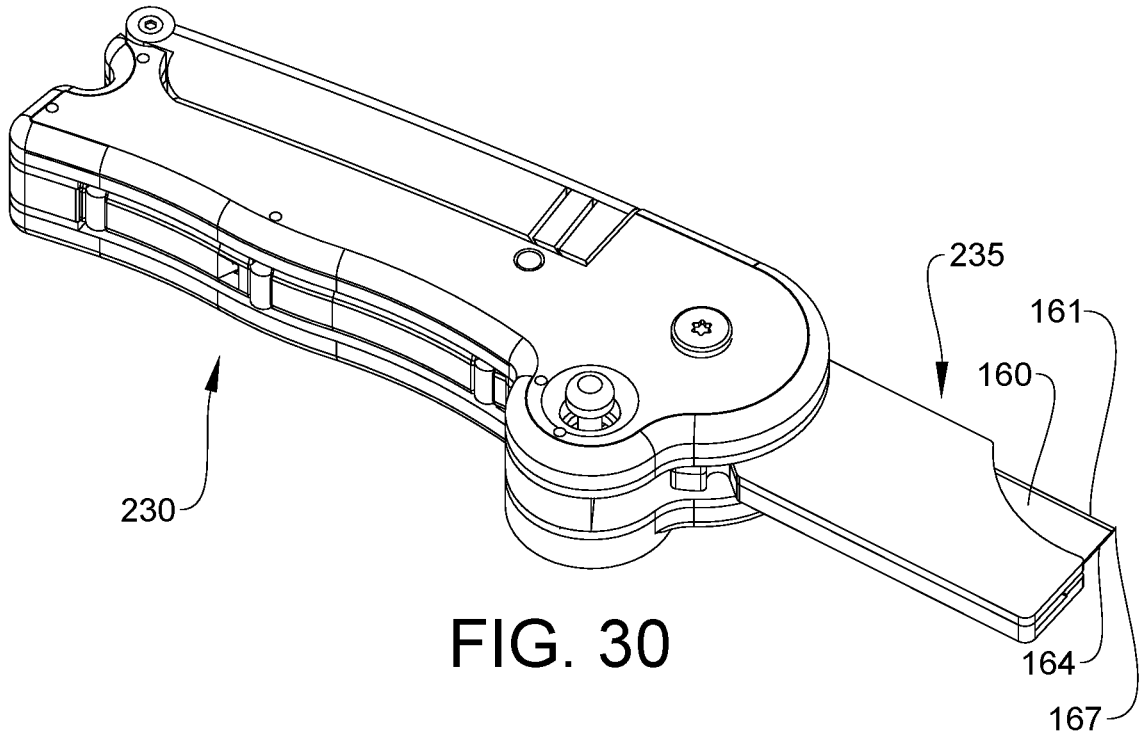
FIG. 30 is a perspective view of the Razor Blade Holder Open Cutting Tool with lever razor blade restraint mechanism.
Figure 31:
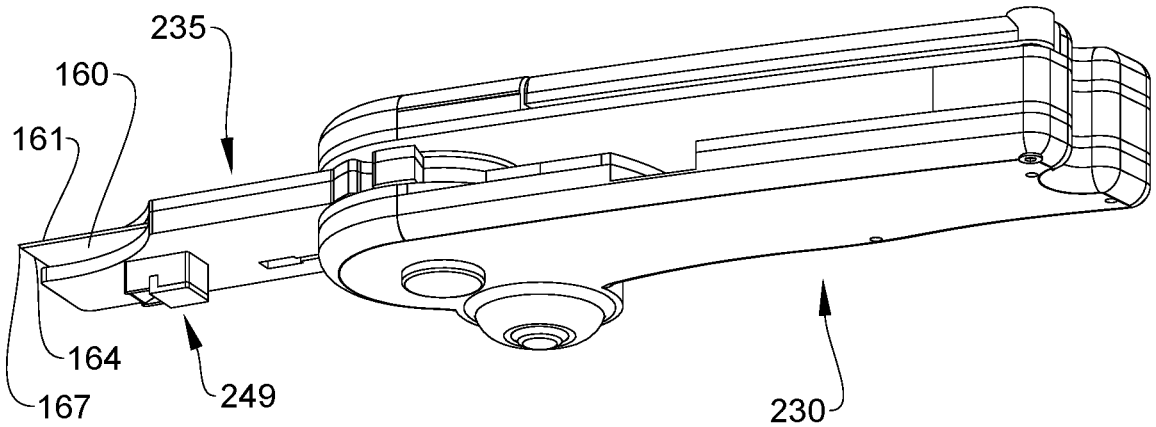
FIG. 31 is an alternate perspective view of the Razor Blade Holder Open Cutting Tool with lever razor blade restraint mechanism.
Figure 32:
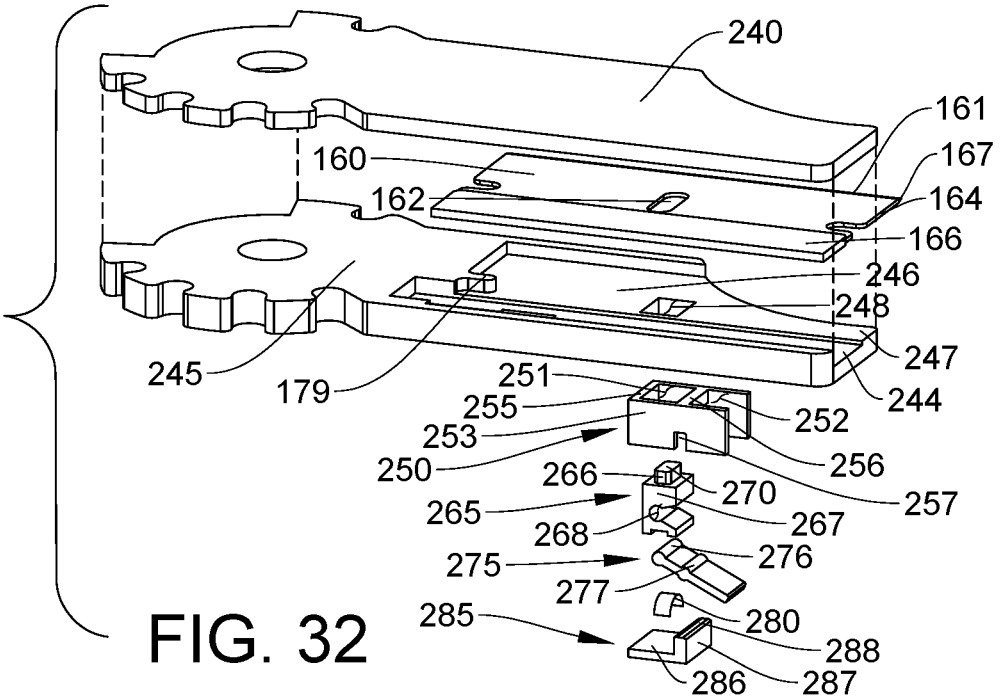
FIG. 32 is an exploded perspective view of the Razor Blade Holder Open Cutting Tool razor open blade holder assembly with lever razor blade restraint mechanism.
Figure 33:
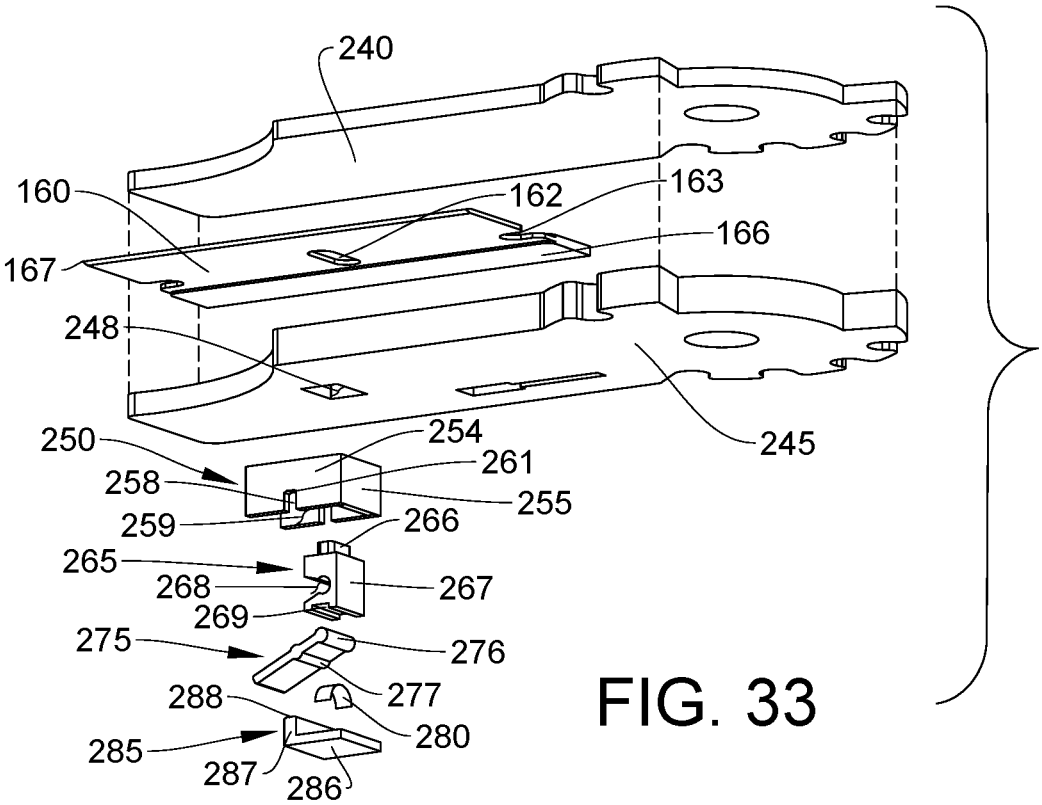
FIG. 33 is an alternate exploded perspective view of the Razor Blade Holder Open Cutting Tool razor open blade holder assembly with lever razor blade restraint mechanism.

Referring to FIGS. 30 and 31: the Razor Blade Holder Open Cutting Tool embodiment presented comprises a razor handle body (230) and a razor open blade holder assembly (235). With the exception of the razor body second half portion recesses to accommodate the blade restraint mechanism, the handle body, use of fasteners and couplings, blade holder rotation control assembly, blade stabilizing projection and razor blade ejector are as with the Razor Blade Tapered Nosing Cutting Tool embodiment cutting tool. The reference numbers for the handle body are different as a consequence of the modified recesses.

The Razor Blade Holder Open Cutting Tool razor open blade holder assembly (235) differs from the tapered nosing blade holder assembly in that the nosing is in essence eliminated exposing portions of the razor blade (160) including a portion of the razor blade cutting edge (161), the razor blade distal point (167), and portions of razor blade distal edge (164). This feature allows for the user to cut as with more traditional cutting tools.

A new blade restraint, the lever razor blade restraint mechanism (249), is now presented and referenced. The Razor Blade Holder Open Tool employing the lever blade restraint mechanism is the preferred embodiment of the holder open tool. It should be noted that the linear razor blade restraint mechanism presented with the Razor Blade Tapered Nosing Cutting Tool and the lever blade restraint mechanism presented here are interchangeable. That is to say that either restraint mechanism can be used with either razor blade holder assembly and thus with either razor cutting tool. Also, the blade holder distal to proximal axis orientation of both restraint mechanisms can be rotated 180 degrees as both are placed in reference to the razor blade center recess and thus reversible. This reversibility feature is not depicted in the drawings.

The open nosing of the Razor Blade Holder Open Cutting Tool was made possible by virtue of the razor blade restraint mechanism being relocated from the distal end of the blade holder assembly as presented in application Ser. No. 17/704,935 to a position closer to the center of the blade holder assembly which in turn was made possible by the newly presented blade restraint mechanisms.

Referring to FIGS. 30-36: The Razor Blade Holder Open Cutting Tool razor open blade holder assembly (235) is comprised of a razor open holder substantially-planar first part (240) and a razor open holder recessed second part (245) which possesses a razor blade open recess (246) in the approximate shape of a standard rectangular single edge razor blade (160). As with other presented tools, the depth of this recess should be selected so as to prohibit excessive movement of the razor blade orthogonal to its thin dimension. The recessed second part razor blade open recess (246) is entirely open on the distal side (247) of the blade holder and partially open adjacent to the razor blade cutting edge (161). When both razor blade holder parts are joined, these parts constrain the blade except as to allow movement (extraction) linearly towards where the recessed second part recess is open. The open holder recessed second part (245) blade open recess (246) is modified (244) to accommodate the additional thickness of the blade where the blade is reinforced (166). A handheld cutting tool employing the razor open blade holder assembly with either the linear or lever blade restraint is the subject of independent claim 5.

Figure 34:
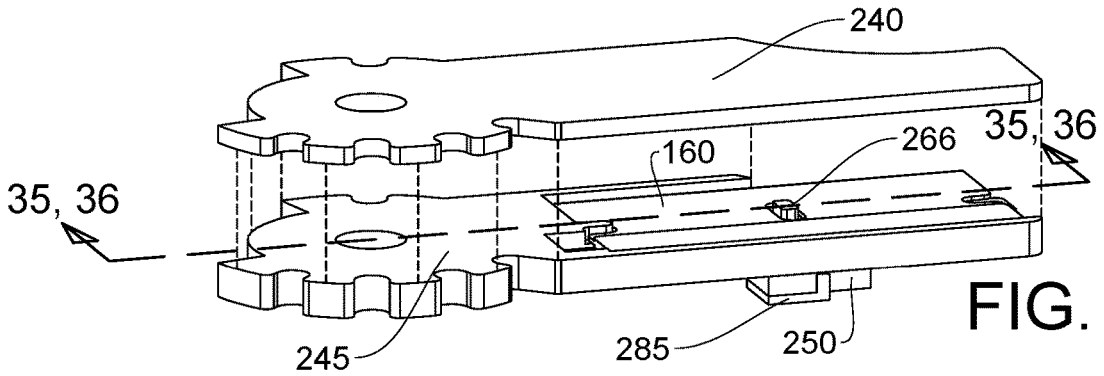
FIG. 34 is a perspective view of Razor Blade Holder Open Cutting Tool defining sections 35 and 36. razor open holder substantially-planar first part is displaced for visual clarity.
Figure 35:
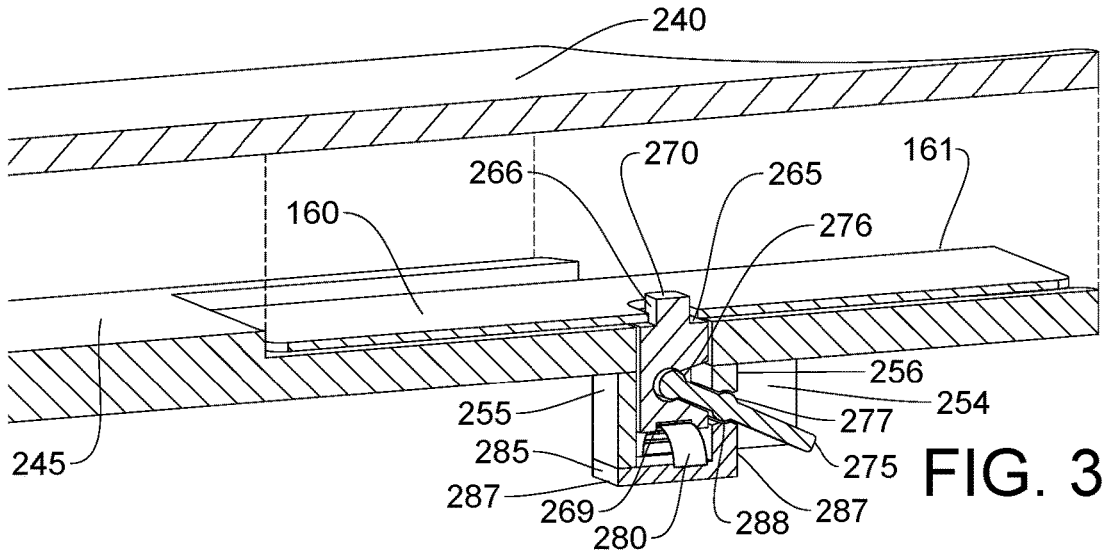
FIG. 35 is a fragmental sectional perspective view of Razor Blade Holder Open Cutting Tool blade holder lever razor blade restraint mechanism in the unactuated/locked position; razor open holder substantially-planar first part is displaced for visual clarity.

Referring to FIGS. 32-36: The Razor Blade Holder Open Cutting Tool lever razor blade restraint mechanism is comprised of a lever restraint void (248) in the recessed second part (245), a lever razor restraint housing (250) placed at the non-blade side of the razor open holder recessed second part lever restraint void (248), a lever razor blade engagement piece (265), a lever element (275), a razor lever spring (280) and lastly a lever housing cover (285). The lever razor blade engagement piece (265) has a single lever razor blade engagement projection (266) which engages the razor blade center recess (162) preventing blade movement when the mechanism is in the unactuated position as shown in FIGS. 34 and 35. The razor lever spring (280) provides a resistive force to oppose movement of the engagement piece to the actuated position shown in FIG. 36 and may be different in type, shape or size as that shown in the figures and may be likewise different than that of the razor linear spring. The razor blade open holder recessed second part (245) and lever housing (250), lever element (275) and lever housing cover (285) when joined, constrain the lever engagement piece (265) to generally linear movement as described by FIGS. 35 and 36.

The lever razor restraint housing (250) is a generally rectangular element with two open areas (251, 252) adjacent the recessed second part. The housing is placed such that the engagement piece (265) after being inserted in the housing will align with the open blade holder recessed second part lever restraint void (248). The lever razor restraint housing has two longitudinal sides (253, 254) and a transverse side (255) all of the same dimension orthogonal to the plane of the recessed second part. Additional elements of the housing are a middle planar portion (256) occurring at the approximate center of the housing (250) parallel to the transverse side and whose dimension orthogonal to the recessed second part is less than that of the three sides. The housing is further comprised of recesses (257, 258), one on each longitudinal side and an open area (259) at the distal portion of the housing and opposite the two top open areas (251, 252). The middle planar portion is formed with an arc (260, FIG. 36 only) shaped recess, as a non-limiting shape, at its base to serve as fulcrum for the lever element. The middle planar portion dimension orthogonal to the blade holder recessed second part allows the lever element to hold the engagement piece in the unactuated position. The recesses (257, 258) on each longitudinal side (253, 254) are each formed with similarly arc shaped recesses (261, FIG. 33 only), again as a non-limiting shape example, aligned with the middle planar portion recess arc—both together serving to constrain and provide a fulcrum for the lever element.

Figure 36:
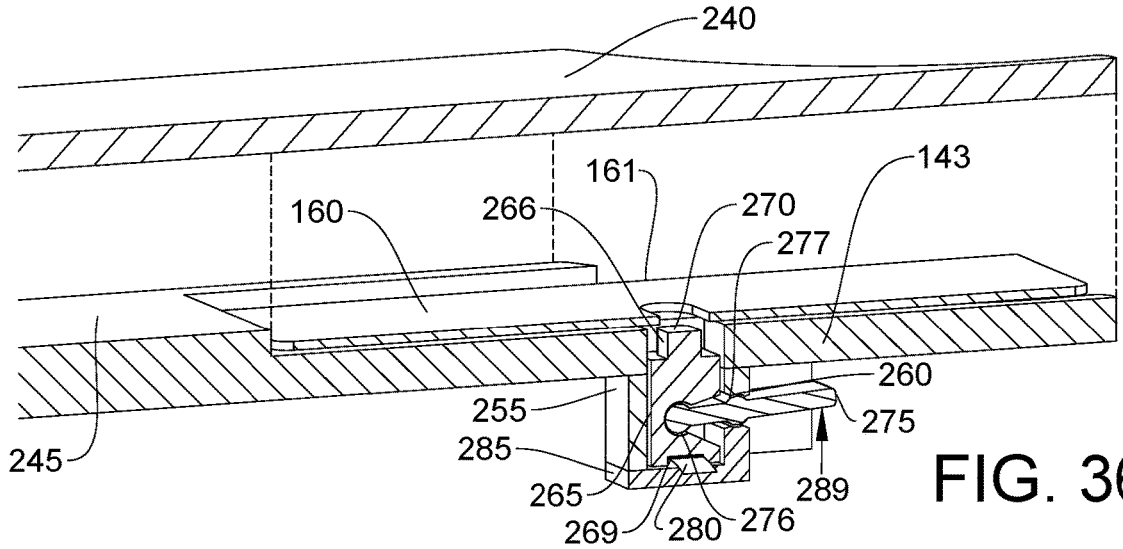
FIG. 36 is a fragmental sectional perspective view of Razor Blade Holder Open Cutting Tool blade holder lever razor blade restraint mechanism in the actuated/unlocked position; razor open holder substantially-planar first part is displaced for visual clarity.

The lever razor blade engagement piece (265) is comprised of a main body (267), a lever razor blade engagement projection (266), which may be in the shape of the single edge razor blade center recess (162) and integrally formed to the main body (267) of the engagement piece, a lever recess (268) within the main body, this recess (268) being open to the blade holder distal side by virtue of two chamfers, as non-limiting shapes. The form of the recess (268) is, as a non-limiting example, a cylinder. The form and angle of the chamfers are such that the lever element (275) contacts or approaches contacting the plane formed by the distal chamfer in the unactuated position as shown in FIG. 35 and the lever element contacts or approaches contacting the plane formed by the proximal chamfer in the actuated position as shown in FIG. 36. Additionally, the lever razor blade engagement piece (265) possesses a rectangular recess (269) at its base to constrain the razor lever spring. The rectangular recess (269) may be open at the longitudinal ends of the spring as the spring is further constrained by the razor lever housing long sides (253, 254).

The dimensions of the lever razor blade engagement piece (265) and lever razor restraint housing (250) are such that the base of the lever blade engagement projection (266), that is where it joins the main body, is aligned with the blade side of the open holder recessed second part when the razor lever spring (280) in the unactuated, that is uncompressed, position and the spring is resting on the lever housing cover (285) as shown in FIG. 35. Absent user action, the spring keeps the mechanism in this position.

The dimensions of the lever blade engagement piece (265) and lever restraint housing (250) are also such that the top (270) of the blade engagement projection (266) is generally aligned with or below the blade side of the open holder recessed second part when the razor lever spring (280) is in contact with the lever housing cover (285) and the spring is compressed, that is, in the actuated position, as shown in FIG. 36. The dimensions and force characteristics of the razor lever spring are also considered in the above.

The lever element is a generally planar element with two portions integrally (276, 277) formed to it. The restraint piece coupling portion (276), shown as a cylindrical shape as a non-limiting example, is placed at the proximal end of the lever element and is of such a dimension as to nest inside the lever recess (268) within the main body of the lever engagement piece (265). Because this coupling portion (276) strikes an arc as the lever is rotated by user force, the lever recess (268) of the lever blade engagement piece (265) must be made slightly larger or eccentric to accommodate this non-linear motion. The lever element also possesses a pivot portion (277) generally near its middle which mates with the middle planar portion (256) arc recess (260) on one side and the lever housing cover (285) on the other. As a non-limiting shape, the pivot portion (277) is formed as a cylinder to mate with the arc recesses of other portions (260, 261, 288) of the lever housing and lever housing cover.

The lever housing cover (285) is an "L" shaped piece with a generally planar base portion (286) parallel to the recessed second part and second portion (287) orthogonal to and integrally connected to the planar base portion. The second portion (287) possesses a second portion recess (288; FIG. 35 only), shaped as an arc as a non-limiting example, to mate with the lever element pivot portion (277) and its dimension orthogonal to the planar base portion is such that it operably constrains the lever element. This dimension is also such that the lever element, when actuated by the user, causes the top (270) of the lever razor blade engagement piece (265) blade engagement projection (266) to be aligned with or below the blade side of the open recessed second part when the razor lever spring is in contact with the lever housing cover (285) and the spring compressed, that is the actuated position, as shown in FIG. 36. The razor lever spring rectangular recess (269) may be placed at the base of the generally planar base portion of the lever housing cover in lieu of the lever razor blade engagement piece location. This is not depicted in the drawings.

When a force (289 arrow in FIG. 36) is applied to the lever element (275) opposite the coupling portion (276), the spring compresses, its ends move outward still within its housing recess and the lever element rotates about its pivot portion and the three recesses (260, 261, 288), the lever element rotation drives the engagement piece towards the bottom cover causing the engagement piece to retract placing its top portion (270) generally aligned with or below the blade side surface of the blade holder recessed second part as shown in FIG. 36 permitting the blade to be extracted.

Note the open holder substantially-planar first part (240) is displaced and all of the blade holder parts and blade restraint elements except the razor lever spring are sectioned in FIGS. 35 and 36. The lever spring is not sectioned to provide to provide a clearer depiction of spring deflection. The lever razor restraint housing (250) may be manufactured as a separate element and attached to the blade holder recessed second part mechanically and/or adhesively after placement of the engagement piece, lever element and razor lever spring. Alternatively, the entire razor lever blade restraint mechanism may be assembled separately and attached to the blade holder parts as one assembly.

A handheld cutting tool employing the lever razor blade restraint mechanism is the subject of independent claim 3.

The Razor Blade Holder Open Cutting Tool handle body, use of fasteners, couplings and rotation control mechanisms are in all respects as with the Tapered Nosing Cutting Tool embodiment.

Figure 37:
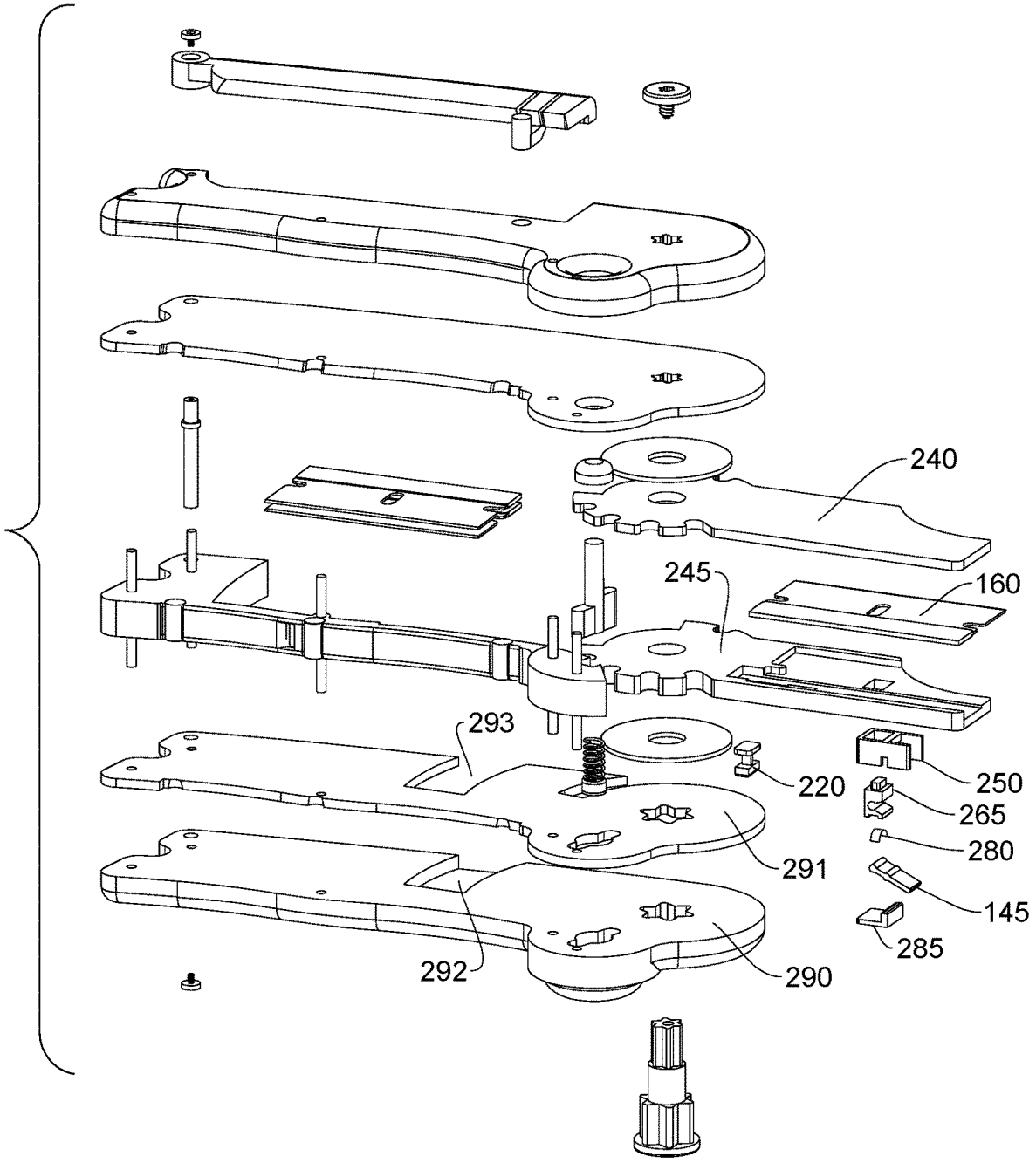
FIG. 37 is an exploded perspective view of the Razor Blade Holder Open Cutting Tool with lever razor blade restraint mechanism.

Referring to FIG. 37: The Razor Blade Holder Open Cutting Tool handle razor holder open second contoured outer layer (290) and the razor holder open second substantially-planar inner layer (291) have been modified as follows: the razor blade lever restraint mechanism is of different dimensions than the linear restraint mechanism and so in order to resolve interference between the lever restraint mechanism and the body layers during blade holder assembly retraction, the recess (292) in the second contoured outer layer (290) and the void (293) in the substantially-planar inner layer (291) and have been modified. Other elements and portions previously described are referenced in FIG. 37 for context.

In all embodiments, the blade holder nosing and the constituent parts that form them may be altered in shape and form so as to provide a cutting angle—the angle between the particular blade and the cutting plane of the object being cut—which improves cutting capabilities for specific cutting tasks. Additionally, in all embodiments, the blade holder nosing and the constituent parts that form them may be altered in shape and form so as to facilitate insertion of the nosing between objects to be cut and objects not intended to be cut. The size and proportion of the various tool constituents may also vary as made possible by differing materials selection and methods of manufacturing.

Figure 24:
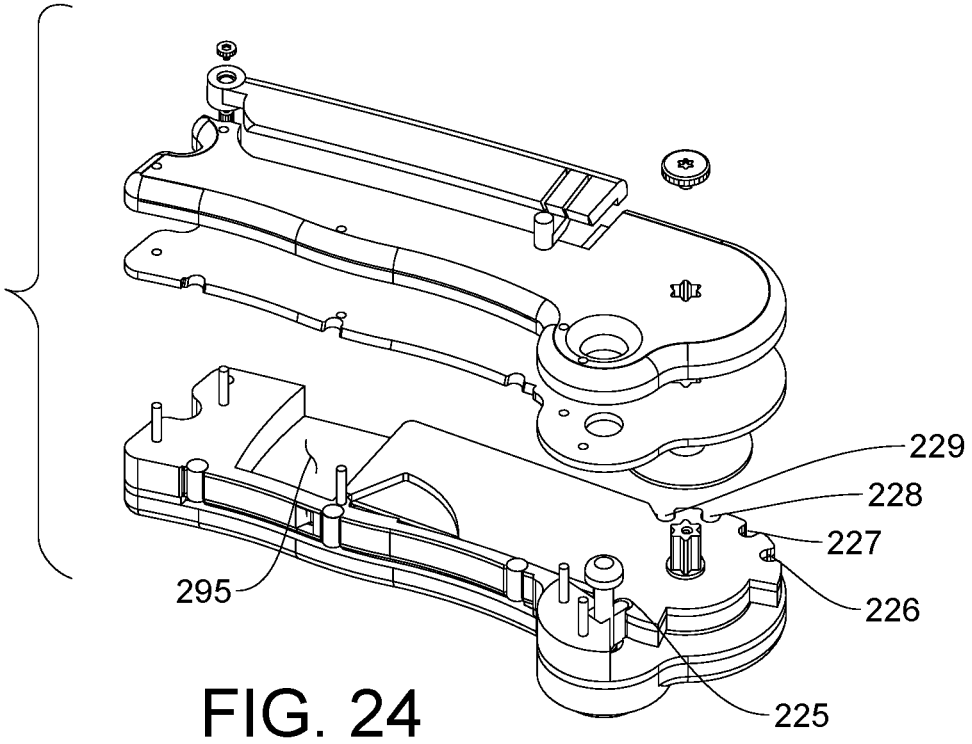
FIG. 24 is a perspective view of Razor Blade Tapered Nosing Cutting Tool with blade holder assembly in the retracted position with portions exploded.
Figure 25:
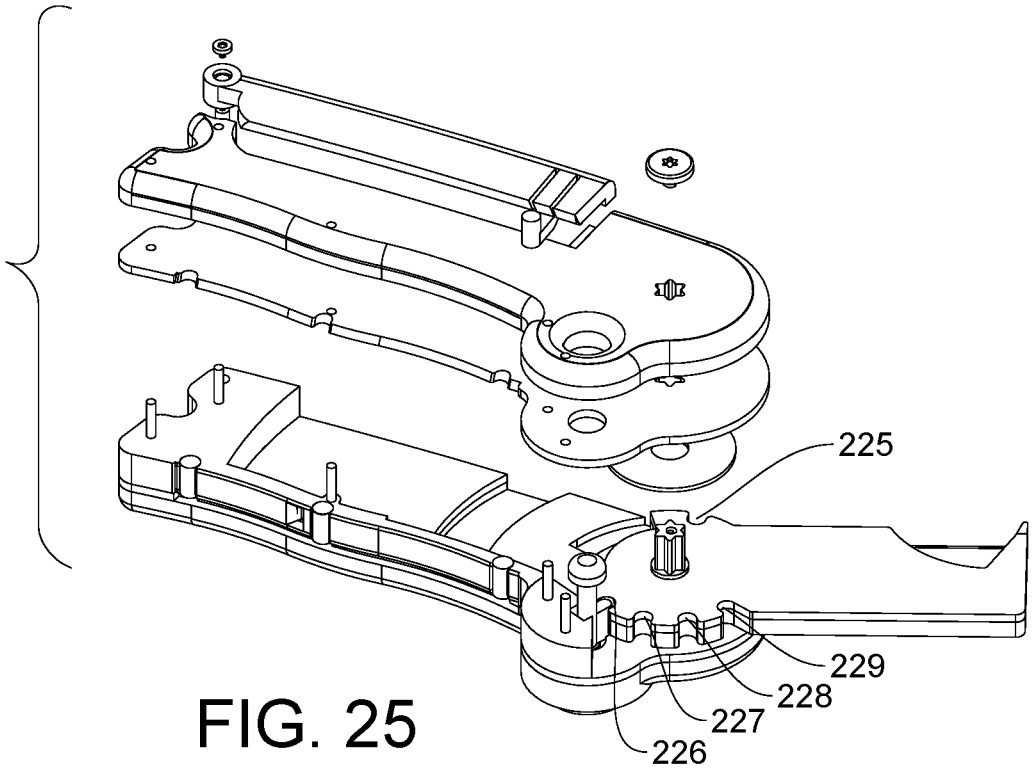
FIG. 25 is a perspective view of Razor Blade Tapered Nosing Cutting Tool with blade holder assembly in the up position with some portions exploded.
Figure 26:
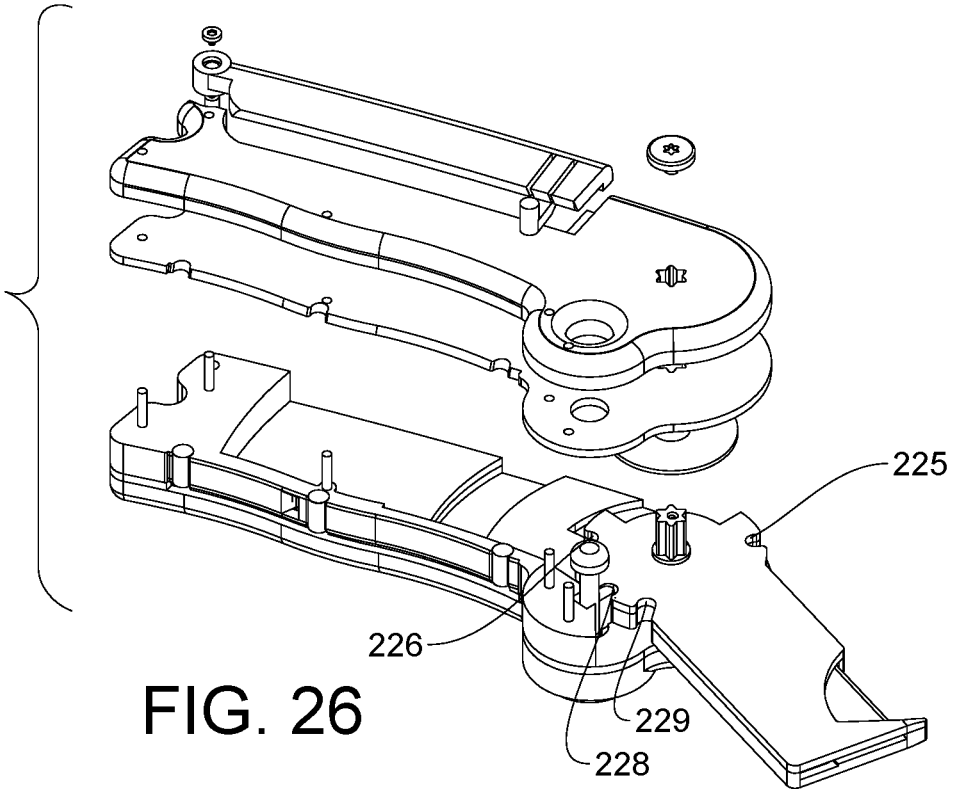
FIG. 26 is a perspective view of Razor Blade Tapered Nosing Cutting Tool with blade holder assembly in the down 1 position with some portions exploded.
Figure 27:
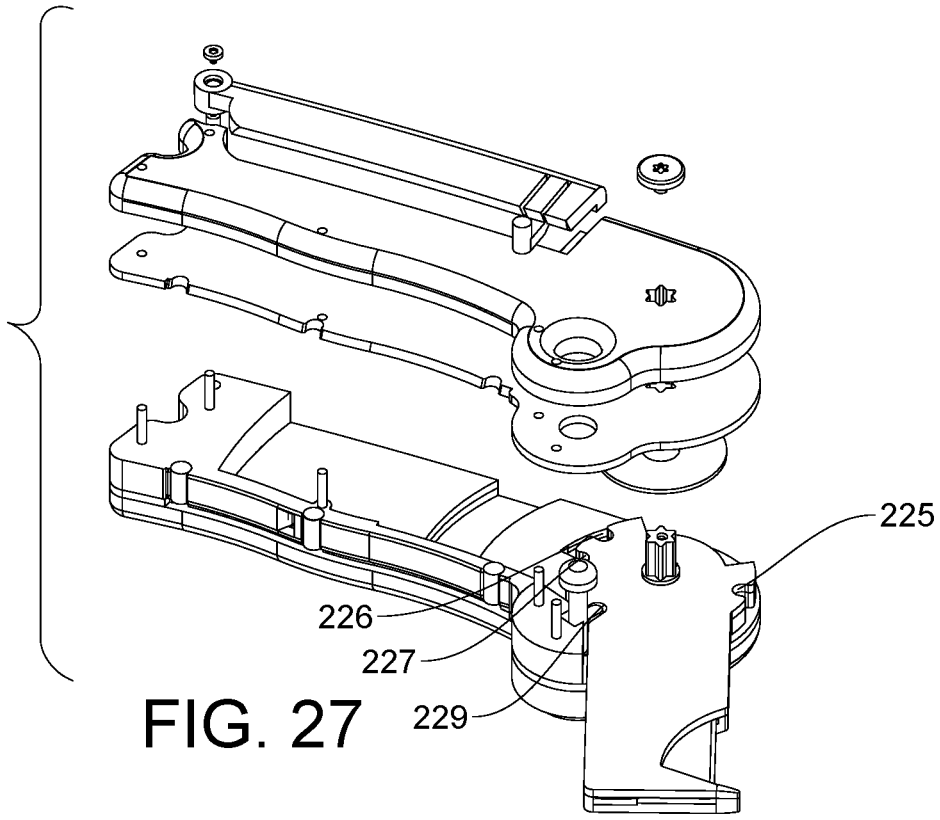
FIG. 27 is a perspective view of Razor Blade Tapered Nosing Cutting Tool with blade holder assembly in the down 2 position with some portions exploded.

Referring to FIG. 24: Additionally, the tool handle bodies may be substantially reduced in size for the razor blade tools as there is sufficient unutilized space in the handle body center space (295; FIG. 24 only) beyond the distal portion of either razor blade holder assembly.

The Razor Blade Holder Open Tool employing the linear blade restraint mechanism is an alternative embodiment of the holder open tool. The linear blade restraint is the same mechanism previously presented with an unelected tool; its description is repeated in paragraphs [0069] through [0077] to provide a complete disclosure for the razor holder open tool. The handle body, use of fasteners and couplings and razor blade ejector are as with the razor tapered nosing tool. The rotational control mechanism employed by the Razor Blade Holder Open Tool with either blade restraint will be described in paragraphs [0079] through [0084] using the linear blade restraint tool as a proxy for both razor open tools. This rotation control mechanism was previously described in paragraphs [0027] through [0030] using an unelected tool as a proxy for all tools of this variant application and is shown again here to provide a complete disclosure of the razor holder open tool.

Figure 38:
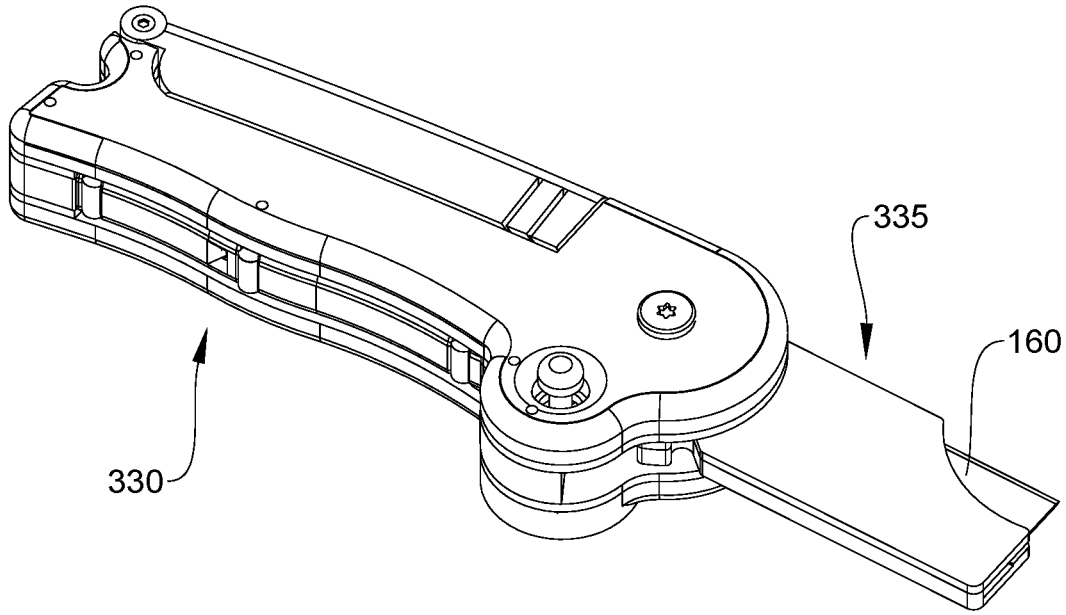
FIG. 38 is a perspective view of Razor Blade Holder Open Cutting Tool with linear razor blade restraint mechanism.
Figure 39:
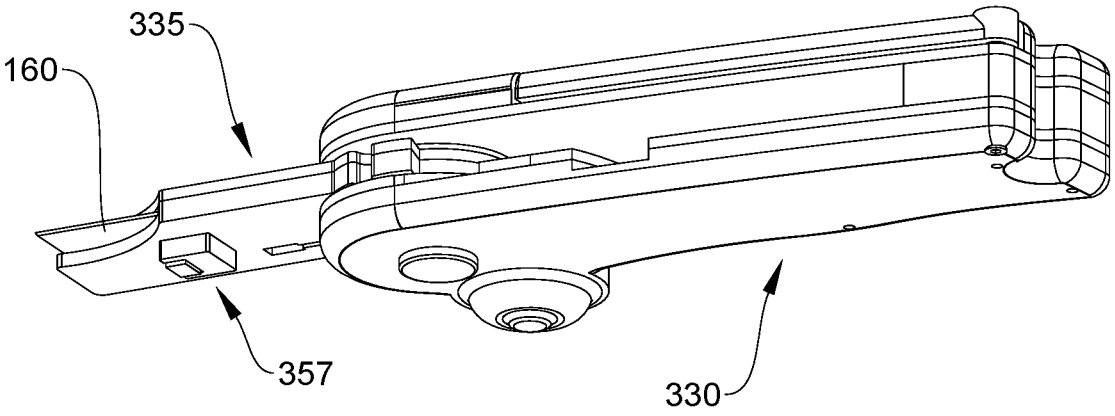
FIG. 39 is an alternate perspective view of Razor Blade Holder Open Cutting Tool with linear razor blade restraint mechanism.
Figure 40:
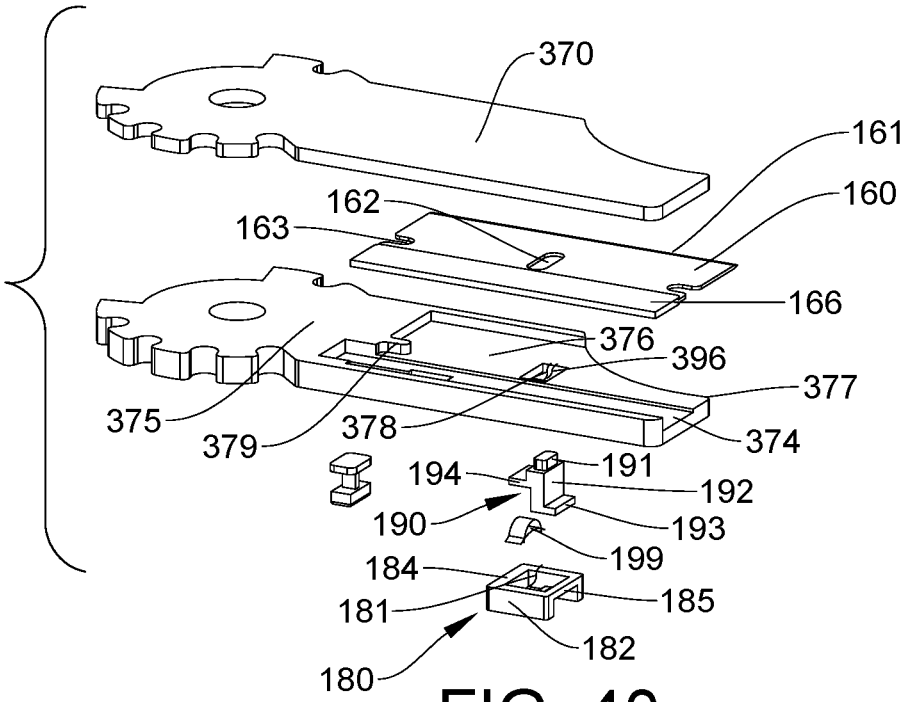
FIG. 40 is an exploded perspective view of the Razor Blade Holder Open Cutting Tool razor open blade holder assembly with linear razor blade restraint mechanism.
Figure 45:
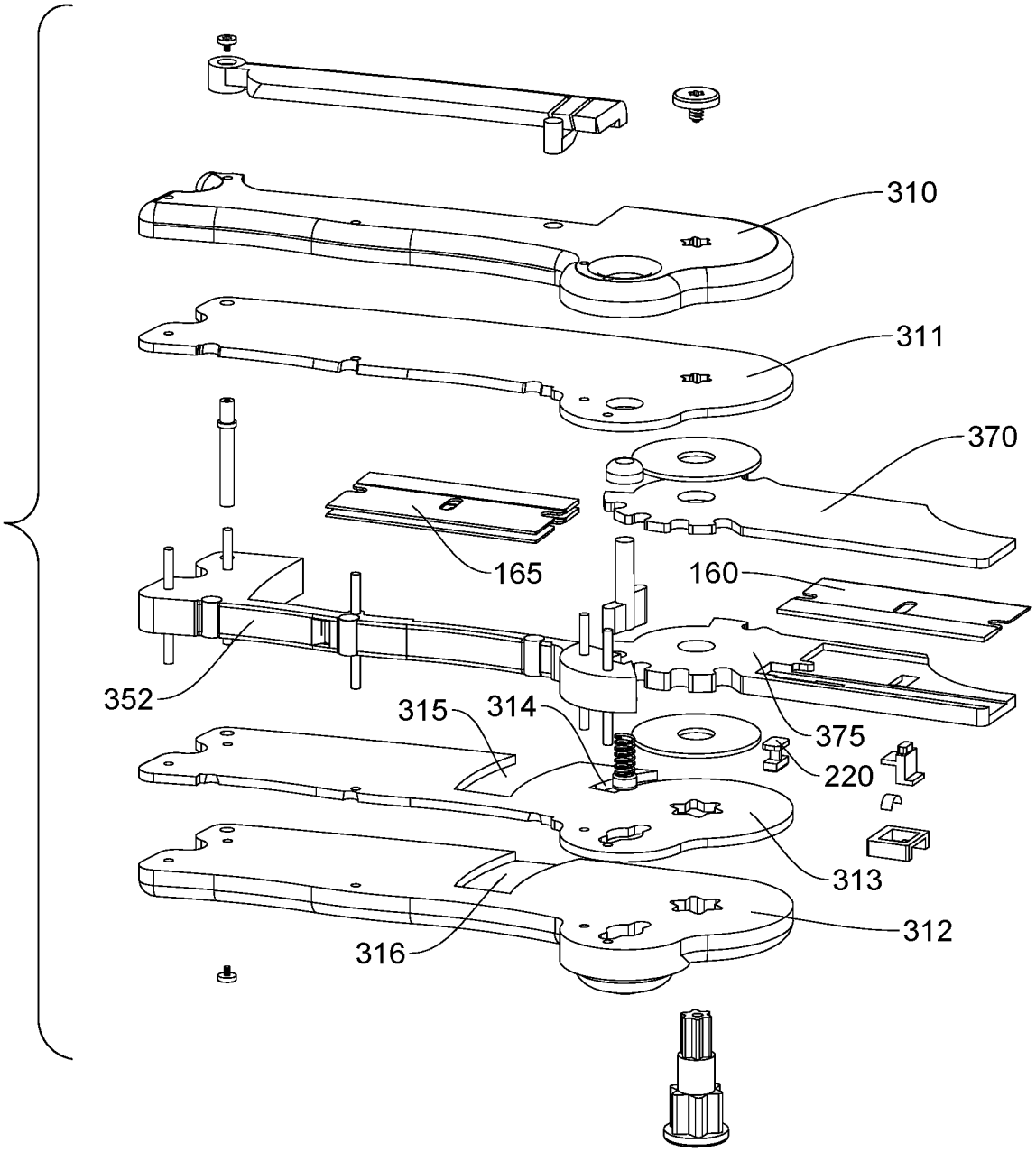
FIG. 45 is an exploded perspective view of the Razor Blade Holder Open Cutting Tool with linear blade restraint mechanism.

Referring to FIGS. 38 and 39: The Razor Blade Holder Open Cutting Tool with linear blade restraint alternative embodiment is primarily comprised of a razor handle body (330), a razor open blade holder assembly (335) and a linear razor blade restraint mechanism (357). The razor handle body is as with as with the handle body of the preferred embodiment with the exception that some recesses (314, 315, 316; FIG. 45 only) are modified to accommodate the linear blade restraint mechanism. The razor open blade holder assembly is as with the preferred embodiment with the exception that some recesses (378, 396, 397; FIG. 40, 41) are modified to accommodate the linear blade restraint mechanism. New reference numbers are used for certain portions of this alternative embodiment to distinguish from the preferred embodiment using the lever blade restraint mechanism.

Referring to FIGS. 38-41: The Razor Blade Holder Open Cutting Tool with linear razor blade restraint mechanism razor open blade holder assembly (335) is comprised of a razor open holder substantially-planar first part (370) and a razor open holder recessed second part (375) which possesses a razor blade open recess (376) in the approximate shape of a standard rectangular single edge razor blade. The depth of this recess should be selected so as to prohibit excessive movement of the razor blade orthogonal to its thin dimension. The razor open holder recessed second part blade open recess is open (377) on the distal side of the blade holder and partially open adjacent to the razor blade cutting edge (161). The recessed second part possesses a linear blade stabilizing projection (379) at the proximal end of the blade recess (376) which nests inside the razor blade proximal side detent (163) when the blade is in the restrained position. This projection (379) serves to prevent blade rotational motion during blade use. Additionally, the razor blade open linear recess depth may be increased in the portion (374) corresponding to areas where the blade is reinforced (166) to position the blade generally parallel to the recessed second part and to facilitate blade stability during tool use. When both razor blade holder parts are joined, these parts constrain the blade except as to allow movement (extraction) linearly towards where the recessed second part recess is open (377).

Figure 41:
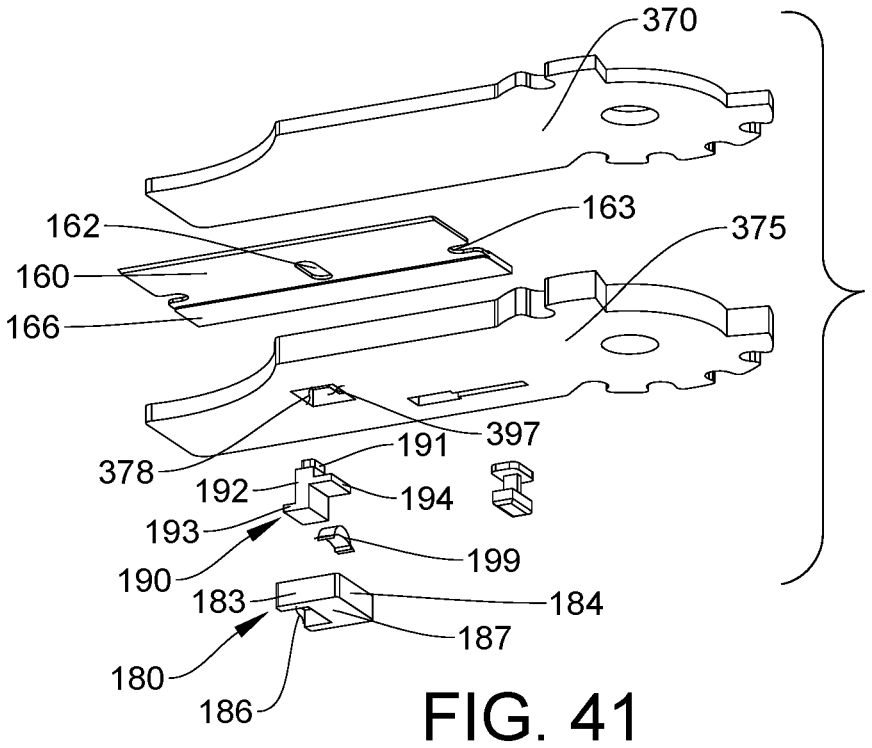
FIG. 41 is an alternate exploded perspective view of the Razor Blade Holder Open Cutting Tool razor open blade holder assembly with linear razor blade restraint mechanism.
Figure 42:
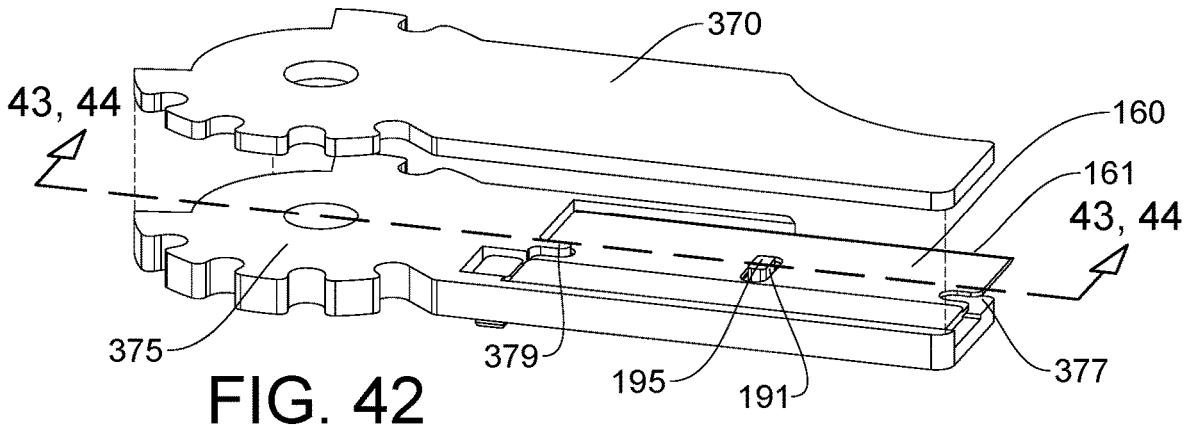
FIG. 42 is a perspective view of Razor Blade Holder Open Cutting Tool defining sections 43 and 44; razor open holder substantially-planar first part is displaced for visual clarity.
Figure 43:
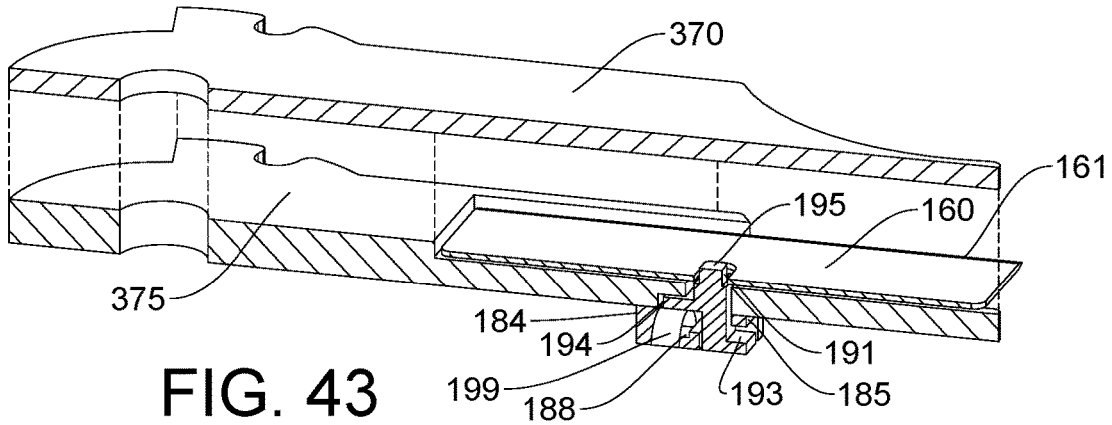
FIG. 43 is a fragmental sectional perspective view of Razor Blade Holder Open Cutting Tool linear razor blade restraint mechanism in the unactuated/locked position; razor open holder substantially-planar first part is displaced for visual clarity.

Referring to FIG. 40-44: The Razor Blade Holder Open Cutting Tool linear razor blade restraint mechanism is comprised of a razor open linear restraint void (378) in the recessed second part (375), a linear razor restraint housing (180) placed at the non-blade side of the razor open linear restraint void (378), a linear razor blade engagement piece (190) and a razor linear spring (199). The linear razor blade engagement piece (190) has a single linear razor blade engagement projection (191) which engages the razor blade center opening (162) preventing blade movement when the mechanism is in the unactuated position as shown in FIGS. 42 and 43. The razor linear spring (199) provides a resistive force to oppose movement of the engagement piece to the actuated position shown in FIG. 44 and is shown in both the compressed and uncompressed state in FIGS. 40 and 41. The razor open holder recessed second part (375) and linear restraint housing (180), when joined, constrain the linear razor blade engagement piece to generally linear movement as described by FIGS. 43 and 44.

The linear razor restraint housing (180) is a generally rectangular element with an open area (181) aligning with the razor open holder recessed second part linear restraint void (378), two longitudinal sides (182, 183), a transverse side (184) and an optional connection bar (185). The housing additionally is formed of an open area (186) at the portion of the housing furthest from the blade holder, that is its base, and an adjacent planar base portion (187; FIG. 41 only). The non-base side of the planar portion possesses a rectangular spring recess (188, shown in FIGS. 43 and 44 only) to accommodate the razor linear spring (199).

The linear razor blade engagement piece (190) is comprised of a main body (192), a linear razor blade engagement projection (191), which may be in the approximate shape of the single edge razor blade center opening (162) and integrally formed to the main body (192) of the engagement piece, a linear pull portion (193), and a spring contact portion (194). The linear pull portion (193) is generally planar, orthogonal to and integrally formed with the main body (192). The spring contact portion (194) is generally planar, orthogonal to and integrally formed with the main body of the engagement piece (190) opposite the linear pull portion and proceeding towards the proximal portion of the blade holder. The distance from the base of the engagement projection (191), that is where it is connected to the main body of the engagement piece, to the non-blade holder side of the spring contact portion (194) generally coincides with the thickness of the razor open holder recessed second part (375) at the void (378). The razor linear spring (199) is formed and placed in the linear housing rectangular spring recess (188) such that in the unactuated position the center of the spring comes into with the non-blade holder side of the spring contact portion (194).

Figure 44:
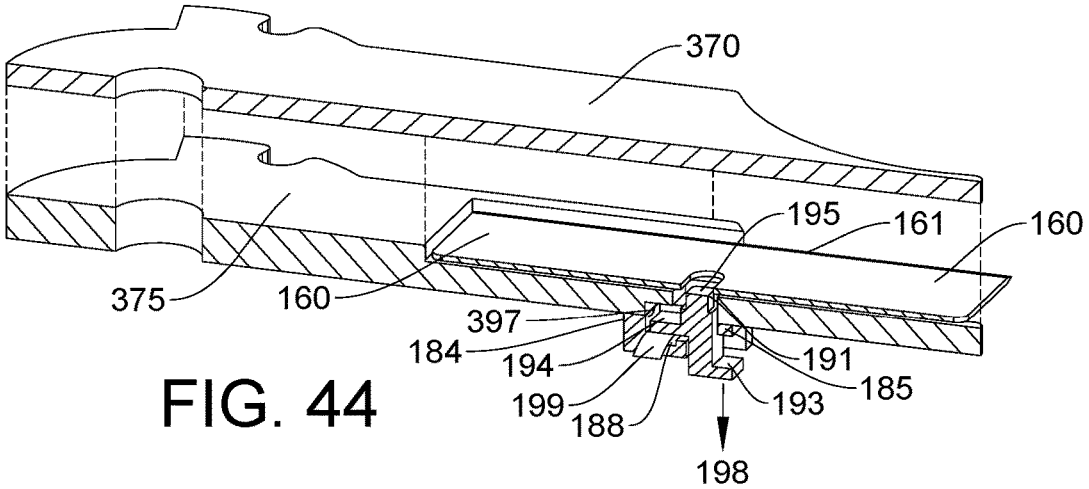
FIG. 44 is a fragmental sectional perspective view of Razor Blade Holder Open Cutting Tool blade holder linear razor blade restraint mechanism in the actuated/unlocked position; razor open holder substantially-planar first part is displaced for visual clarity

The linear restraint void (378) is formed by combining a smaller void (396; FIG. 40 only) and an adjacent recess (397; FIGS. 41 and 44); the smaller void (396) in the approximate dimensions of the linear engagement piece main body portion between base of the linear razor blade engagement projection (191) and the spring contact portion (194). The adjacent recess (397; FIG. 41, 44), is in the approximate dimensions of the spring contact portion and is placed aligned with the recessed second part non-blade side. The spring contact portion (194) nests in this adjacent recess (397) when the mechanism is in the unactuated position and blade side of the adjacent recess limits the movement of the linear engagement piece, both as shown in FIG. 43.

The engagement piece main body is of such a length that the linear pull portion (193) at its base sits generally aligned with the distal plane of the linear razor restraint housing open area (186) and thus the distal plane of the housing planar base portion (187; FIG. 41 only).

In the unactuated position shown by FIGS. 42 and 43, razor linear spring applies a force to the base of the spring contact portion maintaining the engagement projection (191) nested into the razor blade center opening (162) restraining the blade. The razor linear spring may be different in type, shape or size as that shown in the figures.

When a user pulling force (198, arrow in FIG. 44) is applied to the blade side of the linear blade restraint engagement piece (190) linear pull portion (193), the linear spring compresses, its ends move outward, still within the spring recess (188), and the linear engagement piece engagement projection (191) retracts bringing its flat portion (195) aligned with or below with the surface of the open holder recessed second part recess (376) as shown in FIG. 44 permitting the blade to be extracted. The linear razor restraint housing (180) constrains the blade engagement piece so that it moves only in the direction of spring compression and limits its amount of travel. Also, the housing spring recess (188) base may be optionally curved (not shown) to provide improved spring operation. Note the open holder substantially-planar first part (370) is displaced and all the blade holder parts shown are sectioned in FIGS. 43 and 44 except the linear spring which is not sectioned to provide a clearer depiction of spring deflection. Construction of the blade holder assembly may be facilitated by forming the linear razor restraint housing (180) as a separate element and attaching to the blade holder recessed second part mechanically and/or adhesively after placement of the engagement piece and the razor linear spring in the rectangular recess (188) and prior to housing attachment.

A handheld cutting tool employing the linear razor blade restraint mechanism is the subject of independent claim 2.

Referring to FIG. 45: For the Razor Blade Open Holder Cutting Tool the razor handle body is comprised of a razor handle body first half portion further comprised of a razor first contoured outer layer (310) and a razor first substantially-planar inner layer (311) and a razor handle body second half portion further comprised of a razor second contoured outer layer (312) and a razor second substantially-planar inner layer (313). A razor handle body center portion (352) is placed between the razor handle body first and second half portions.

A razor blade ejector (220) serves to drive the blade out of the blade holder assembly when required for blade change thus diminishing injury risk to the user. It is inserted into the wide portion of an opening provided in the razor open holder recessed second part at a 90-degree angle during manufacture and before blade holder assembly. The razor blade ejector portion that contacts the blade side is shaped as a rectangle to ensure maximum contact with the blade and to provide linear blade movement. Once inserted and rotated 90 degrees to its normal position and the blade holder parts are joined, it is restrained from movement other than linearly along its track to exert force on the blade proximal side to partially eject it for replacement. The razor blade ejector is an optional element of the razor tool and may be omitted. The razor blade ejector (220) of the razor open blade holder assembly can be made of proportions to eliminate the interference with the razor second contoured outer layer (312). Thus, as shown in FIG. 45 the recess in that layer associated with interference has been eliminated. The void (314) in the razor second substantially-planar inner layer (313) for the blade ejector remains. The void (315) in the razor second substantially-planar inner layer (313) and the recess (316) in the razor second contoured outer layer (312) accommodating the razor blade linear restraint mechanism have been moved and enlarged to resolve interference with the razor blade holder assembly during blade holder retraction.

Figure 46:
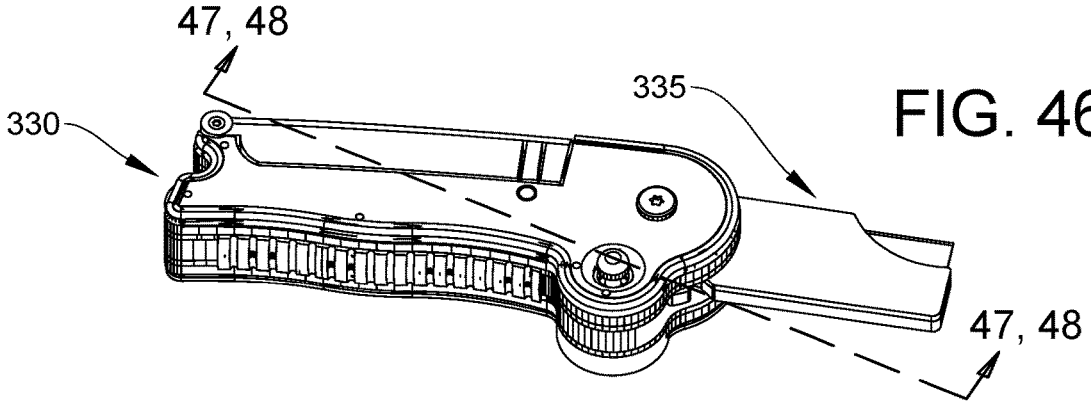
FIG. 46 is a perspective view of Razor Blade Holder Open Cutting Tool defining sections 47 and 48.
Figure 47:
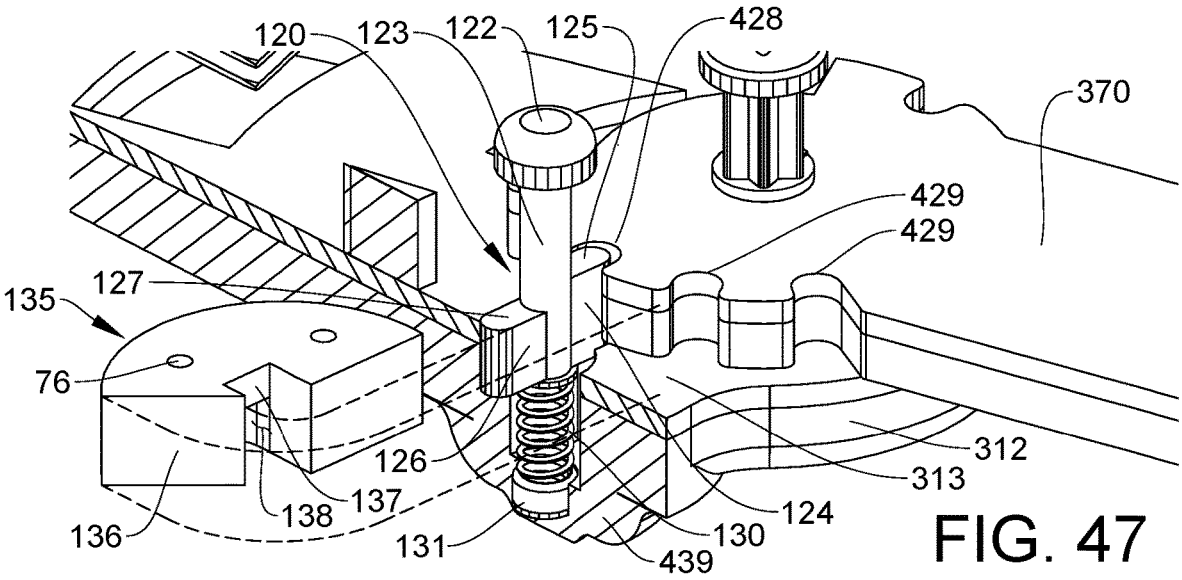
FIG. 47 is a fragmental sectional perspective view of Razor Blade Holder Open Cutting Tool blade holder rotation control assembly in the unactuated/locked position; pinning component restraint is displaced and rotated for visual clarity.
Figure 48:
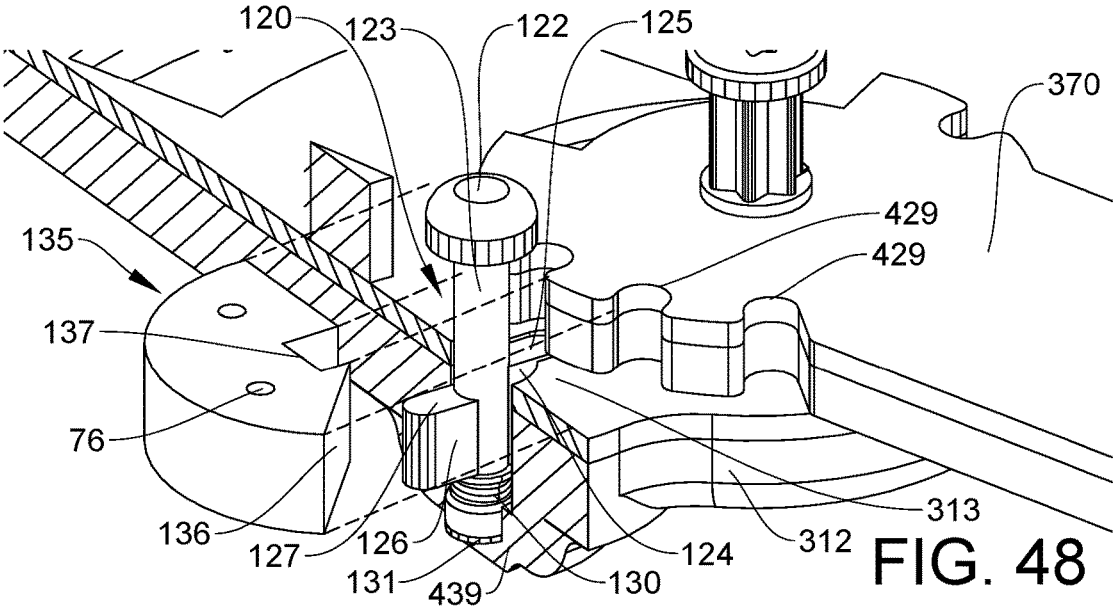
FIG. 48 is a fragmental sectional perspective view of Razor Blade Holder Open Cutting Tool blade holder rotation control assembly in the actuated/unlocked position; pinning component restraint is displaced for visual clarity.
Figure 49:
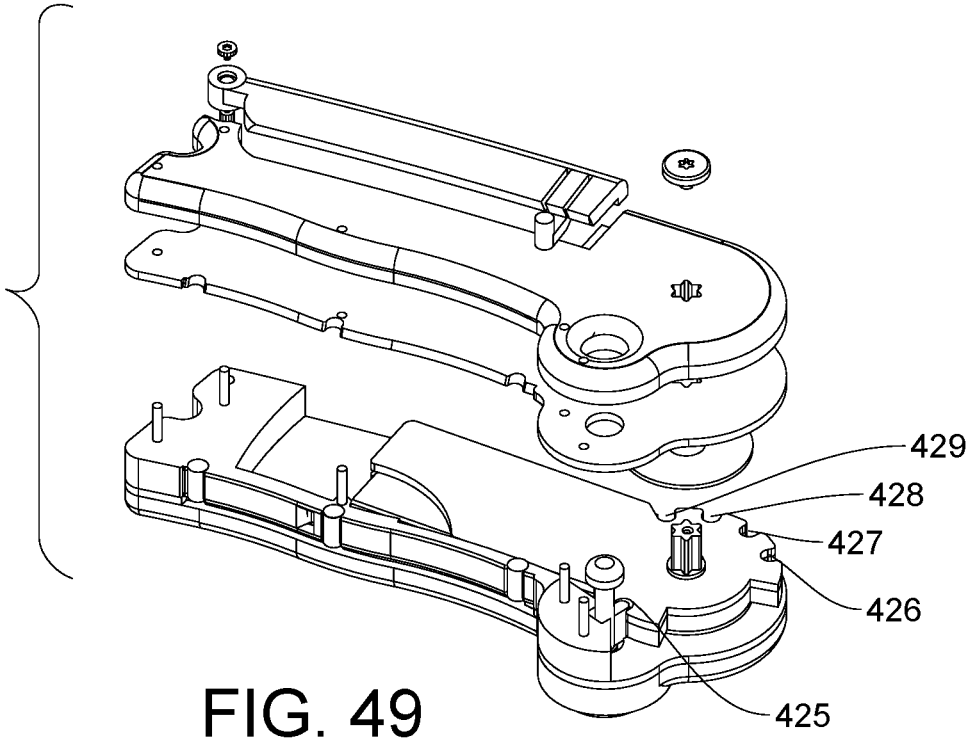
FIG. 49 is a perspective view of Razor Blade Holder Open Cutting Tool with razor open blade holder assembly in the retracted position with some portions exploded.
Figure 50:
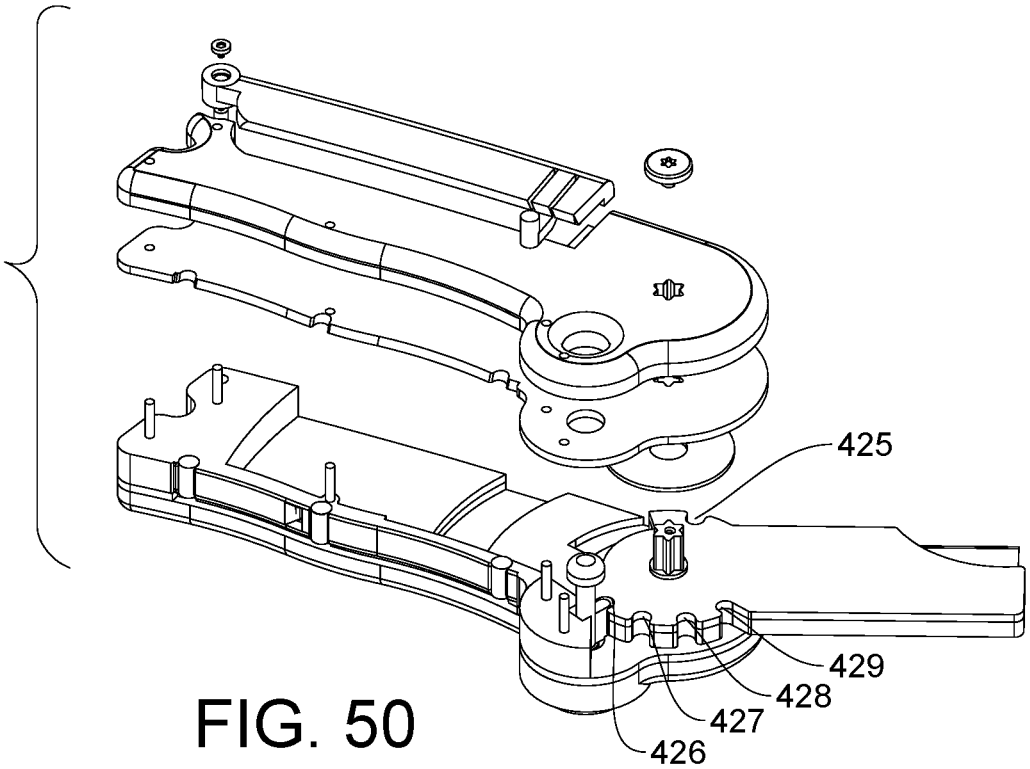
FIG. 50 is a perspective view of Razor Blade Holder Open Cutting Tool with razor open blade holder assembly in the up position with some portions exploded.
Figure 51:
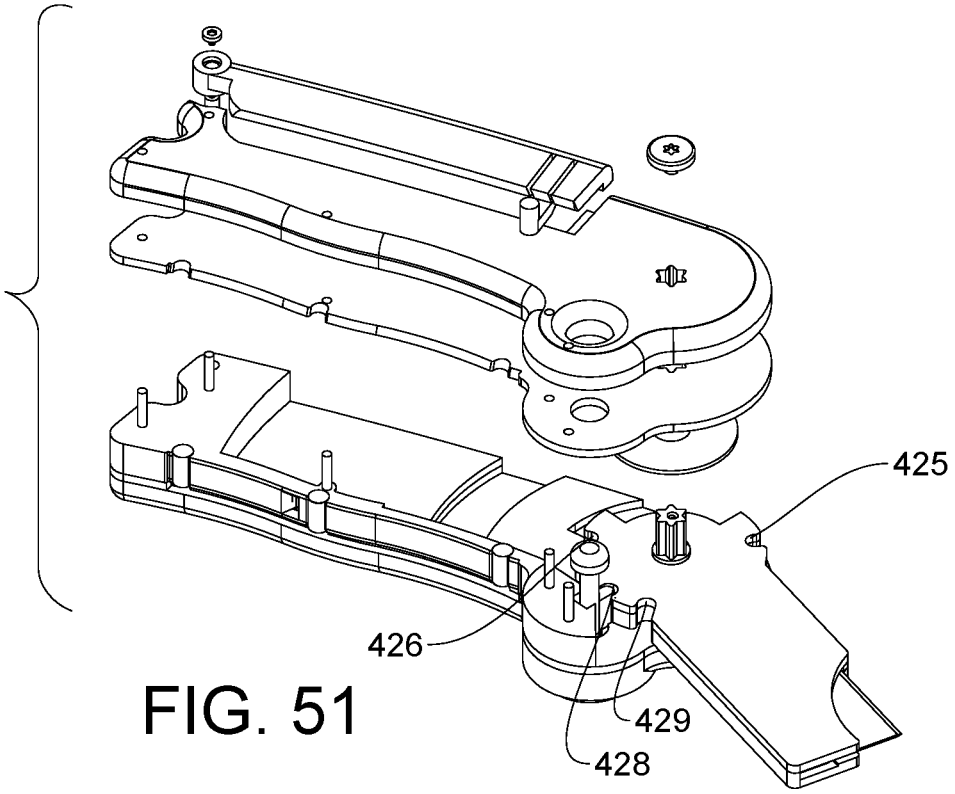
FIG. 51 is a perspective view of Razor Blade Holder Open Cutting Tool with razor open blade holder assembly in the down 1 position with some portions exploded.
Figure 52:
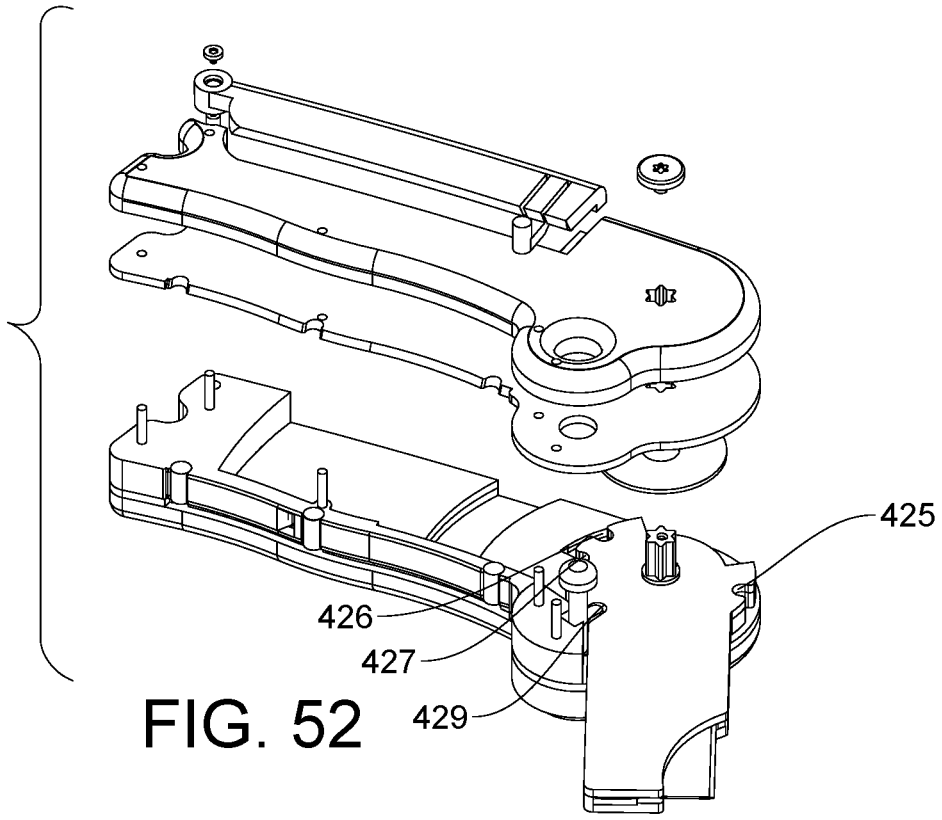
FIG. 52 is a perspective view of Razor Blade Holder Open Cutting Tool with razor open blade holder assembly in the down 2 position with some portions exploded.

Referring to FIGS. 46-48: The blade holder rotation control assembly previously presented with an unelected tool is described. The rotation control assembly is essentially the same assembly for all presented cutting tool embodiments; the rotation control assembly is described here using the Razor Blade Holder Open Cutting Tool as representative of all razor cutting tool embodiments.

The blade holder rotation control assembly is comprised a pinning component (120) with connected push button (122), a spring element (130), a pinning component restraint piece (135) and a plurality of detents (429, not all referenced) along the periphery of the blade holder most proximate to the pinning component. Depressing the push button actuates the mechanism permitting the blade holder assembly to rotate about the axis of the axially aligned coupling. Note that in FIG. 47 the pinning component restraint piece (135) is displaced and rotated and in FIG. 48 it is displaced—both to provide visual clarity. Rotation control assembly elements are not sectioned in either FIG. 47 or 48 to better describe their operation.

Referring to FIGS. 47 and 48: The pinning component (120) is comprised of a center cylindrical portion (123) with integrally connected projecting first and second portions (124, 126) having a form of, as a non-limiting example, a substantially rectangular elements with ovalized shape away from the center cylindrical portion. The projecting first portion (124) interfaces with the blade holder parts. This portion (124) is connected to the center cylindrical portion (123) so that its flat portion (125) generally aligns with the adjacent (428) blade holder planar first part (370) when the button is not actuated as shown FIG. 47. This is the locked position. When the push button (122) is depressed, the spring element (130) is compressed and the entire pinning component (120) is displaced along its longitudinal axis so that the first flat portion (125) now aligns with the adjacent handle body second substantially-planar inner layer (313). The pinning component is now not engaged with the blade holder detent thus permitting the blade holder assembly to rotate freely as shown in FIG. 48. Opposite to the projecting first portion (124) is a projecting second portion (126) which is similar in form but differs in that its placement along the center cylindrical portion (123) is altered to permit interfacing with the pinning component restraint piece (135). The pinning component restraint piece constrains the pinning component resisting both rotational and linear forces applied to the pinning component by the blade holder assembly during tool use. The pinning component restraint piece (135) may be formed as a cylinder segment flattened on two sides, one of which—side (136)—serves to limit blade holder assembly travel in the unlocked position. The pinning component restraint piece (135) has a substantially rectangular recess (138, FIG. 47) Formed to accommodate the pinning component projecting second portion (126) and a restraint projection (137) at this recess to constrain and limit the pinning component travel along its longitudinal axis. The pinning component second connected portion flat portion (127) comes into contact with the base of the restraint projection (137) in the locked position to provide this limit. The pinning component restraint has openings (76) to permit conjoining to the handle body portions using cylindrical pins.

The pinning component (120) is held at its unactuated position by a spring element (130), a helical compression spring shown in the drawings as non-limiting example, and which may have a generally flat cylindrical element (131) placed or connected at either end to provide strength and stability to the spring operation. Other force resisting devices or spring types may be used in place of the helical spring. The top flat cylindrical element is not referenced in the drawings for clarity. As shown in FIGS. 45, 47, and 48, voids and recesses in both first and second half layer portions and a projection (439) from second contoured outer layer (312) form a housing for the spring and rotation control elements. The projection also possesses a recess to house the spring element.

Referring to FIGS. 49-52: the rotational functioning of the open blade holder assembly and rotational control assembly is described and illustrated using the Razor Holder Open Blade Cutting Tool cutting tool. Please note some portions are exploded as indicated by brackets to more clearly show the blade holder/rotational control assembly interface. As previously described the razor open holder substantially-planar first part and recessed second part both have a plurality of detents which serve to engage the pinning component first portion and thus the entire rotation control assembly. In the presented embodiment, the blade holder parts have five positions and a detent for each as a non-limiting example of possible configurations. The tool positions are shown as: retracted, FIG. 49; up position, FIG. 50; down position 1, FIG. 51; down position 2, FIG. 52; fully extended, FIGS. 38 and 39. The positions followed by their specific detent reference numbers are given here: retracted (425), up position (426), fully extended (427), down position 1 (428) and down position 2 (429). The varied positions afford the user the ability to make cutting motions at a variety of angles with relation to the plane of the materials to be cut. Both the number and angular positioning of the detents can be optionally modified.

Figure 53:
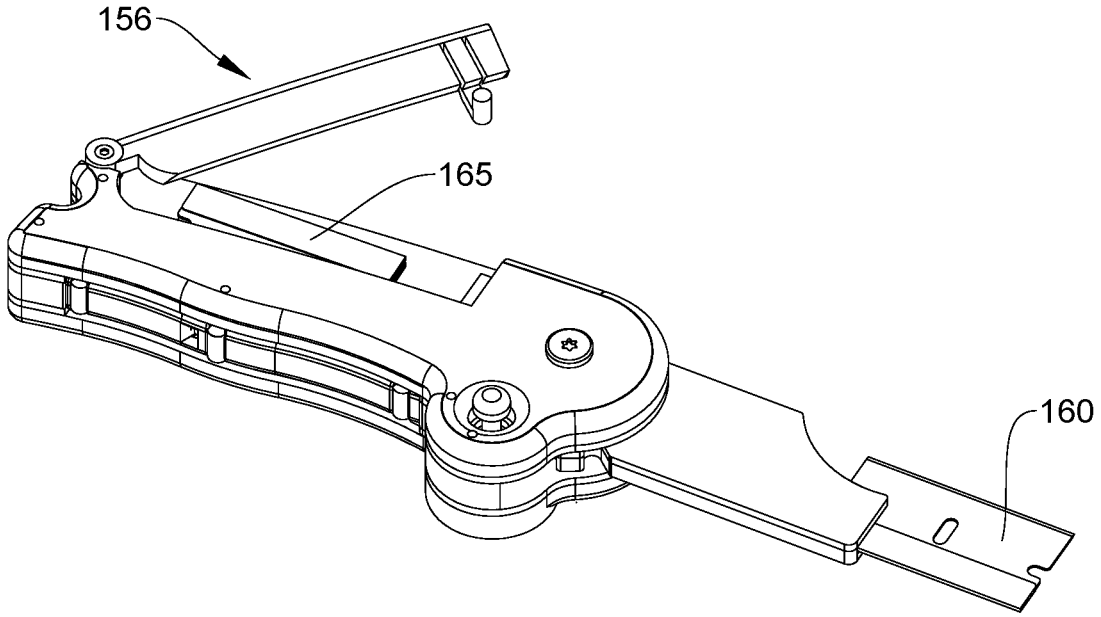
FIG. 53 is a perspective view of the Razor Blade Holder Open Cutting Tool with spare blade compartment cover partially open and razor blade partially removed.
Figure 54:
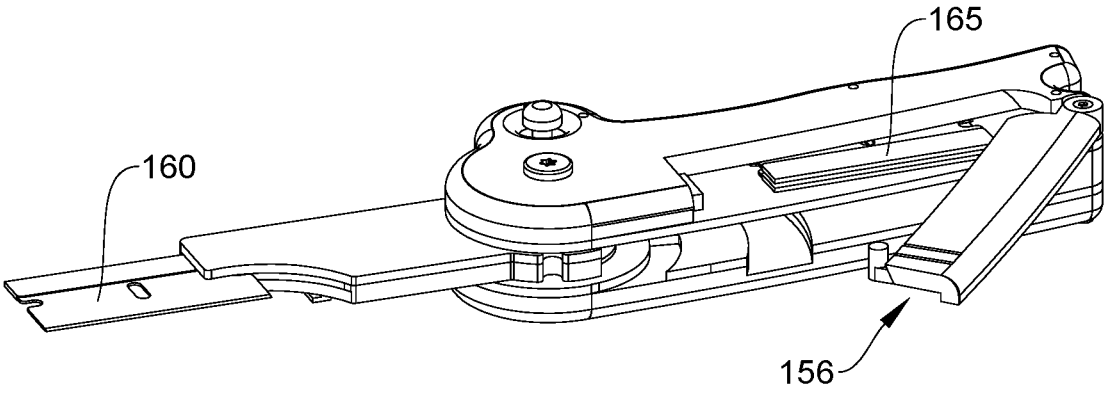
FIG. 54 is an alternate perspective view of the Razor Blade Holder Open Cutting Tool with spare blade compartment cover partially open and razor blade partially removed.

Referring to FIGS. 53 and 54: The Razor Blade Holder Open Cutting Tool with linear razor blade restraint mechanism embodiment is shown with the razor spare blade compartment cover (156) partially open, the spare blades (165) visible and the razor blade (160) partially ejected from the blade holder assembly.

Description of materials of fabrication presented as non-limiting examples:

For the more complex layer elements of the handle body such as the contoured outer layers, materials for fabrication may be relatively high strength plastics such as polypropelene and ABS. For those tool elements requiring higher fracture resistance, thermoplastic elastomers may be used and for color fastness of outer layers, polyoxymethylene. These same material considerations apply to the blade holder recessed parts and blade holder rotation control assembly pinning component restraint element.

For elements possessing simpler, more planar shapes and requiring more rigidity and fracture resistance such as the inner layers of the handle body and the generally planar first part of all blade holder types, metals may be appropriate. Die cast metals such as zinc aluminum alloys may also be appropriate for tool elements requiring greater strength and flexural resistance. Stamping, including combining operations of blanking and punching may be appropriate for these as well as the blade holder flat layer element.

Blade holder rotation control assembly pinning component, connected push button, blade restraints and blade ejectors may be manufactured by casting appropriate yield and tensile strength steel including but not limited to grade five or, if higher strength is required, by casting or machining metal with higher yield and tensile strength steel such as grade eight steel.

All dimensions given or described include some margin allowing for movement without binding or excessive friction and manufacture limitations.

What is claimed is:

1. A handheld cutting tool, comprising:

a razor handle body;

a razor or razor open blade holder assembly comprising:

a linear razor blade restraint mechanism for constraining or, alternately, releasing a replaceable razor blade without tool disassembly further comprising:

and a razor linear spring formed and fabricated so as to provide a resistive force;

a linear razor blade engagement piece possessing a linear razor blade engagement projection for engaging or, alternately, not engaging with a razor blade center opening and a linear pull portion for receiving user force and facilitating user actuated blade release; and a linear razor restraint housing formed to receive, restrain and guide said linear razor blade engagement piece;

and one, or a plurality of, recesses, voids and/or projections formed to cooperatively interface with said linear razor blade restraint mechanism and allow for said linear razor blade engagement piece generally linear motion.

2. A handheld cutting tool, comprising:

a razor handle body;

a razor or razor open blade holder assembly comprising:

a lever razor blade restraint mechanism for constraining or, alternately, releasing a replaceable razor blade without tool disassembly further comprising:

a lever element formed with a restraint piece coupling portion and a pivot portion, lever element rotational motion occurring about the pivot portion;

a lever razor blade engagement piece possessing a lever razor blade engagement projection for engaging or, alternately, not engaging with a razor blade center opening, a recess formed to receive said lever element restraint piece coupling portion and to permit lever element articulation;

a lever razor restraint housing formed to receive, restrain and guide said lever razor blade engagement piece and possessing portions serving as a fulcrum for lever element rotational motion;

a razor lever spring formed and fabricated so as to provide a resistive force; and a lever housing cover;

and one, or a plurality of, recesses, voids and/or projections formed to cooperatively interface with said lever razor blade restraint mechanism and allow for said lever razor blade engagement piece generally linear motion.

3. A handheld cutting tool, comprising:

a razor handle body;

a razor open blade holder assembly comprising:

a razor open holder substantially-planar first part;

a razor open holder recessed second part possessing a razor blade open recess, said razor blade open recess shaped substantially in the form of a replaceable razor blade, said razor blade open recess being open adjacent a distal portion of the razor blade cutting edge and said razor blade open recess being open at a distal end of the razor open holder recessed second part;

an arced portion at a proximal end of the razor open holder substantially-planar first part and an arced portion at a proximal end of the razor open holder recessed second part, both said arced portions possessing a plurality of detents along their periphery;

a cylindrical opening in both the razor open holder substantially-planar first part and the razor open holder recessed second part, both the openings formed to receive a coupling or fastener, said coupling or fastener pivotally connecting the blade holder assembly to the handle body and said coupling or fastener serving as a pivot point for razor open blade holder assembly rotational motion; and the razor open holder substantially-planar first part and the razor open holder recessed second part both formed so as to contiguously expose the distal portion of the razor blade cutting edge, a razor blade distal point and portions of the razor blade distal edge;

and a blade holder rotation control assembly comprising:

a pinning component further comprising:

a center cylindrical portion;

a projecting first portion capable of being operably engaged to both said arced portion detents most proximate to the pinning component projecting first portion in any of a plurality of razor open blade holder rotational positions; and a projecting second portion;

a pinning component restraint piece, said restraint piece capable of being operably engaged to the pinning component projecting second portion so as to restrict pinning component rotational motion about a pinning component longitudinal axis; and a push button operably connected to the pinning component whose actuation provides movement of the pinning component along the pinning component longitudinal axis so as to operably disengage the pinning component projecting first portion from both said arced portion detents most proximate to the pinning component thus permitting razor blade holder rotational motion.

4. The handheld cutting tool of claim 3, wherein, the razor open blade holder assembly further comprises an opening in the razor open holder recessed second part and a razor blade ejector placed in said opening to assist in ejecting the replaceable razor blade.

5. The handheld cutting tool of claim 3, the razor handle body comprising:

a razor handle body first half portion having a razor first contoured outer layer and a razor first substantially-planar inner layer;

a razor handle body second half portion having a razor second contoured outer layer and a razor second substantially-planar inner layer; and a razor handle body center portion being disposed between the razor handle body first half portion and the razor handle body second half portion, said razor handle body first half, second half and center portions arranged, configured and joined to create a body structure for said cutting tool.

6. The handheld cutting tool of claim 3, the razor handle body comprising:

the razor handle body first half portion and its constituent layers formed as one component; and the razor handle body second half portion and its constituent layers and the razor handle body center portion all formed as one component, said components arranged, configured and joined to create a body structure for said razor handle body.

7. The handheld cutting tool of claim 3 wherein a plurality of razor handle body portions and layers are conjoined and constrained by a plurality of fasteners adhesively or mechanically bonded to said handle body portions and layers.

8. The handheld cutting tool of claim 3 further comprising portions intended to interface with and be restrained by an axially aligned coupling and possessing openings which are the negative of a polygonal shaped radially adjacent portion of the coupling and further comprising portions intended to interface with and be permitted rotation by the axially aligned coupling and possessing openings which are the negative of a cylindrically shaped radially adjacent portion of the coupling.

9. The handheld cutting tool of claim 3 wherein the razor handle body possesses a spare blade compartment further comprised of:

a spare blade compartment cover pivotally connected to the razor handle body by a two-sided flanged coupling and fastener, said cover characterized by a:

a generally planar portion;

an integrally connected orthogonal portion; and a locking mechanism.

* * * * *